US011505900B2

(12) United States Patent
Thomas, Sr.

(10) Patent No.: US 11,505,900 B2
(45) Date of Patent: Nov. 22, 2022

(54) ELEVATED ROADWAY QUASI-EQUILIBRIUM SUPPORT SYSTEM

(71) Applicant: Rupert R. Thomas, Sr., Edmond, OK (US)

(72) Inventor: Rupert R. Thomas, Sr., Edmond, OK (US)

( * ) Notice: Subject to any disclaimer, the term of this patent is extended or adjusted under 35 U.S.C. 154(b) by 0 days.

(21) Appl. No.: 17/162,557

(22) Filed: Jan. 29, 2021

(65) Prior Publication Data

US 2021/0238809 A1 Aug. 5, 2021

Related U.S. Application Data

(60) Provisional application No. 62/968,508, filed on Jan. 31, 2020.

(51) Int. Cl.

| | |
|---|---|
| ***E01C 11/26*** | (2006.01) |
| ***E01D 19/08*** | (2006.01) |
| ***E01F 5/00*** | (2006.01) |
| ***E01D 4/00*** | (2006.01) |

(52) U.S. Cl.

CPC ..... *E01C 11/26* (2013.01); *E01D 4/00* (2013.01); *E01D 19/086* (2013.01); *E01F 5/005* (2013.01)

(58) Field of Classification Search

CPC ..... E01C 11/26; E01C 11/265; E01D 4/00; E01F 5/005

See application file for complete search history.

(56) References Cited

U.S. PATENT DOCUMENTS

| | | | | |
|---|---|---|---|---|
| 6,592,288 | B2 * | 7/2003 | Chun | E01C 9/00 238/14 |
| 6,682,259 | B1 | 1/2004 | Thomas et al. | |
| 2020/0011557 | A1 | 1/2020 | Thomas, Sr. | |

FOREIGN PATENT DOCUMENTS

| | | | |
|---|---|---|---|
| CN | 106638226 | * | 5/2017 |
| CN | 211291820 | * | 8/2020 |
| CN | 111979866 | * | 11/2020 |

OTHER PUBLICATIONS

"HPWREN and Seismic Warning Systems Partner to Pioneer Earthquake Notifications for Californians," High-Performance Wireless and Research Education Network, PRNewswire, Oct. 5, 2015.

* cited by examiner

*Primary Examiner* — Gary S Hartmann
(74) *Attorney, Agent, or Firm* — Dunlap Codding, P.C.

(57) ABSTRACT

Structures and methods for controlling road temperature over an underpass space are disclosed, including a structure comprising: footings underlying the road supporting a support assembly comprising: an inner shell; a plurality of beams surmounting the inner shell; an insulating material for thermally isolating the road and the remainder of the support assembly from the underpass space; an outer shell; a temperature control assembly; temperature sensors disposed in the road and the support assembly; and a computer processor configured to receive temperature and weather forecast data; predict changes to the temperature of the support assembly and the road based on the temperature and forecast data; and control the application or removal of heat to the support assembly, based on the predicted changes to the temperature of the support assembly and the road, resulting in the road maintaining a temperature within a predetermined range.

18 Claims, 13 Drawing Sheets

ELEVATED ROADWAY QUASI-EQUILIBRIUM SUPPORT SYSTEM

CROSS-REFERENCE TO RELATED APPLICATIONS

The present application claims priority to provisional patent application identified by U.S. Ser. No. 62/968,508, titled "ELEVATED ROADWAY QUASI-EQUILIBRIUM SUPPORT SYSTEM," filed on Jan. 31, 2020, the entire contents of which are hereby expressly incorporated by reference herein.

FIELD OF THE DISCLOSURE

The disclosure generally relates to methods and systems for controlling elevated road temperature. More particularly the disclosure relates to a system including an underlying structure to the road. The underlying structure comprises a controlled temperature system based on internal and external conditions and/or future conditions, so as to control the temperature of the adjacent road and the underlying structure in a quasi-equilibrium state. Control of the road temperature may be predictive control based at least in part on predictive analysis of future conditions. Control of water flow around the structure is also contemplated. Additionally, systems for controlling the path of vehicles on the road are disclosed.

BACKGROUND

Climatic influences, such as heat and cold, cause steel, concrete and other elements of bridges, whether highway, railway, or recreational, for example, to expand and contract in varying increments over time. By such movement, the integrity of the bridge can be eroded and ultimately destroyed. In particular, the more extreme freeze/thaw cycles reduce the strength of the bridge, and the bridge must therefore be constructed with more strength than would otherwise be necessary.

In addition, during inclement cold weather, roadways which are not in direct contact with the ground, such as bridges, culverts, and overpasses (referred to herein in general as elevated roadways), tend to ice over more quickly than the ground-based roadways leading to and from the elevated roadways. It is well recognized in the art that freezing or frozen liquid on elevated roadways greatly increase the hazards of winter driving. Accidents result from the elevated roadways becoming coated with frost, ice, or snow, sooner and more often than the approaching ground-based roadways. Frost, ice, or snow on elevated roadways causes slick conditions, which result in loss of friction for automobiles driving on the elevated roadways, leading to loss of control and accidents. Maintaining vehicles on the road would be an advantage, as safe use of elevated roadways is important to drivers and to public policy.

Further, water flow mitigation is an important aspect to the safety of roadways and underpasses. Additionally, keeping a clean environment is of major importance to peoples' health and to the economy.

It would represent an advance in the state of the art to provide elevated roadway structures which did not suffer from the aforementioned problems of the movement of the bridges, and the bridges and underpasses becoming coated with frozen liquid sooner and more often than their approach pavements. It is to such a unique structure having an insulated support assembly that the present invention is directed.

SUMMARY OF THE INVENTION

Broadly, the present invention relates to a structure, which in one preferred embodiment can be utilized as a bridge for supporting a road along a road axis over an underpass space spanned by the bridge or in a second preferred embodiment can form a culvert. In the one preferred embodiment, the road has a predetermined width extending in a direction transverse to the road axis. The structure may include two footings underlying the road with each footing being securely mounted to the earth. The footings may be spaced apart in a direction substantially parallel to the road axis.

The structure may also include an arcuate support assembly supported by the footings. The support assembly extends at least the width of the road and traverses the underpass space for supporting the road across the underpass space spanned by the structure. The support assembly includes a substantially continuous inner shell, a plurality of rigid, resilient beams, an insulating material, and an outer shell.

The substantially continuous inner shell has a width at least corresponding to the road. The inner shell may extend between the two footings so as to define the underpass space spanned by the structure.

The rigid, resilient beams may surmount the inner shell. Each beam may have a first end supported by one of the footings, and a second end supported by the other footing. The beams may be spatially disposed in a direction transverse to the road axis and have a longitudinal axis extending in a direction substantially parallel to the road axis.

The insulating material may be positioned between each of the beams for thermally isolating the road and the remainder of the support assembly from the underpass space and substantially preventing the transfer of heat there through.

The outer shell may have a first end supported by one of the footings, and a second end supported by the other footing. The outer shell may substantially encase the beams and the insulating material.

A substantially fluid impermeable material may substantially encase the support assembly and a fill material may extend from the substantially fluid impermeable material to support the road.

The support assembly may also include a pair of sidewalls extending parallel to the road axis on either side of the support assembly. The sidewalls may be provided with an inner insulating layer to prevent heat from migrating through the sidewalls.

Thus, it can be seen that the insulating material provided between the beams and in the sidewall substantially prevent the fill material, and thus the road supported thereby, from losing heat through the sidewalls and the support assembly. Furthermore, the fill material acts as an insulator to insulate the support assembly. This stabilizes the temperature of the structure so as to prevent or reduce the aforementioned problems associated with the expansion and contraction of the structure, and the icing over of the road supported thereby.

In colder geographic regions where there are extended periods of below freezing weather, a heat exchange assembly may be disposed throughout the fill material, the roadbed or the road extending through the underpass to selectively maintain the temperature of the fill material, the roadbed, or the road extending through the underpass within a predetermined range so as to reduce the possibility of the road supported by the structure or passing through the underpass from icing over. A temperature control source may be connected to the heat exchange assembly for providing a source of heat to the heat exchange assembly for controlling the temperature of the fill material, the roadbed, or the road passing through the underpass. The temperature control source may be controlled by an environmental control computer which receives information from 1) various temperature sensors disposed in the roadbed, the fill material, or the road passing through the underpass, 2) a wind sensor located near the structure, or 3) a weather information receiver receiving information from any suitable source of weather forecasts, such as the National Weather Service. The environmental control computer may receive the various information discussed above, and selectively control the temperature control source to control the temperature of the road passing over the structure, the fill material and thus, the temperature of the support assembly, and the road passing through the underpass defined by the structure so that the expansion and contraction of the support assembly, and the icing over of the road passing over the structure, and the road passing through the underpass space are substantially reduced.

The system may predict the effects of environmental conditions on the structure and the road and may cause incremental changes in the temperature of the structure and/or the road to maintain a quasi-equilibrium state.

In some implementations, the system may predict water flow through the underpass and divert water between culverts based on the predicted water flow.

In some implementations, a magnetically controlled road system may comprise a road having a longitudinal axis and containing ferrous material positioned in a pattern aligned with the longitudinal axis, the pattern configured to, when the ferrous material is magnetized, generate a magnetic force such that a vehicle on the road is guided by the magnetic force. The pattern may be configured to, when the ferrous material is magnetized, generate the magnetic force such that the vehicle on the road is guided by the magnetic force in a predetermined direction.

BRIEF DESCRIPTION OF THE SEVERAL VIEW OF THE DRAWINGS

The accompanying drawings, which are incorporated in and constitute a part of this specification, illustrate one or more implementations described herein and, together with the description, explain these implementations. The drawings are not intended to be drawn to scale, and certain features and certain views of the figures may be shown exaggerated, to scale, or in schematic in the interest of clarity and conciseness. Not every component may be labeled in every drawing. Like reference numerals in the figures may represent and refer to the same or similar element or function. In the drawings.

DETAILED DESCRIPTION OF THE INVENTION

Figure 1:
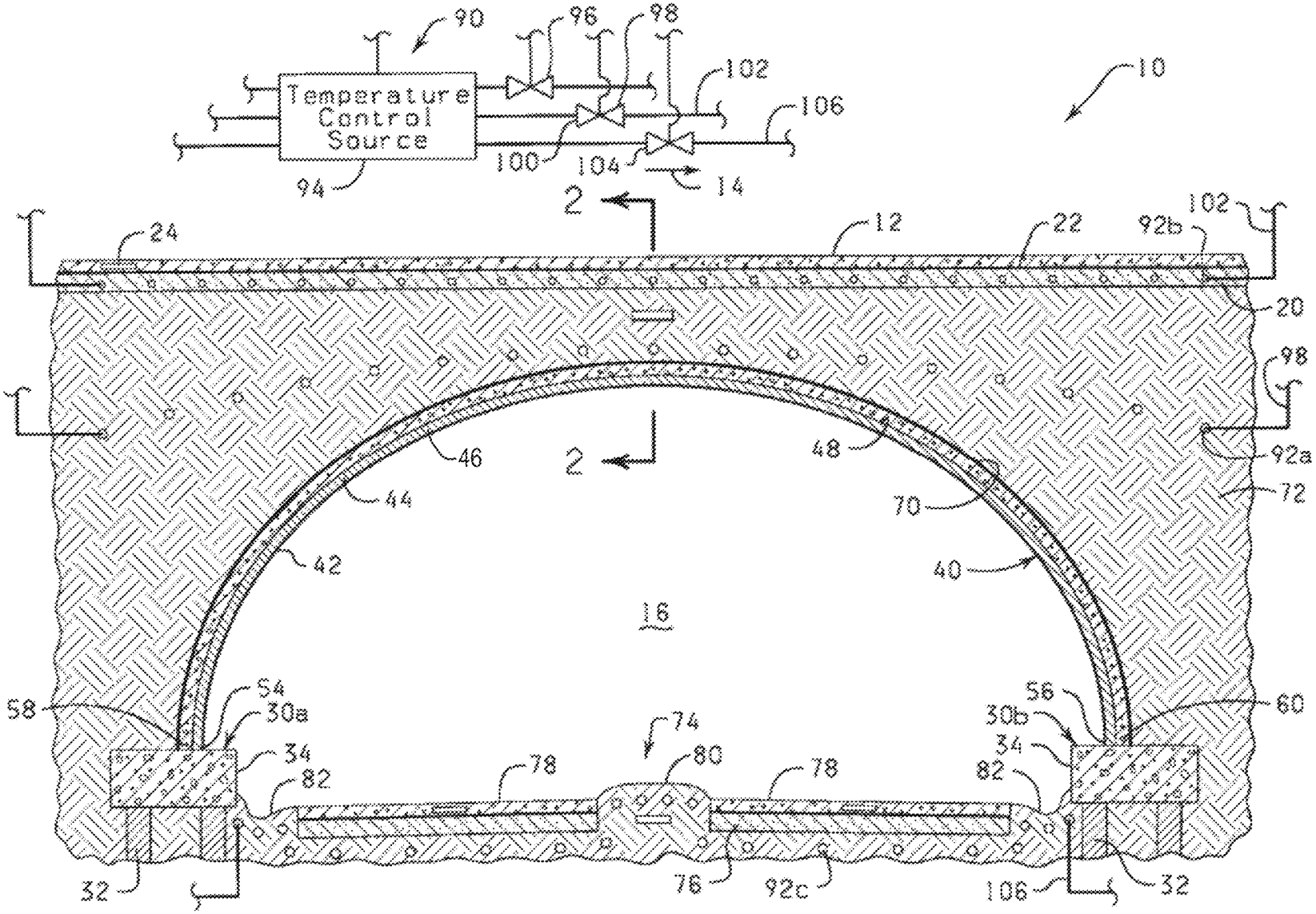
FIG. 1 is sectional view of a structure constructed in accordance with the present invention.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or more and the singular also includes the plural unless it is obvious that it is meant otherwise.

Further, use of the term "plurality" is meant to convey "more than one" unless expressly stated to the contrary.

As used herein, qualifiers like "substantially," "about," "approximately," and combinations and variations thereof, are intended to include not only the exact amount or value that they qualify, but also some slight deviations therefrom, which may be due to manufacturing tolerances, measurement error, wear and tear, stresses exerted on various parts, and combinations thereof, for example.

The use of the term "at least one" or "one or more" will be understood to include one as well as any quantity more than one. In addition, the use of the phrase "at least one of X, V, and Z" will be understood to include X alone, V alone, and Z alone, as well as any combination of X, V, and Z.

The use of ordinal number terminology (i.e., "first", "second", "third", "fourth", etc.) is solely for the purpose of differentiating between two or more items and, unless explicitly stated otherwise, is not meant to imply any sequence or order or importance to one item over another or any order of addition.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Software may include one or more computer readable instructions that when executed by one or more components cause the component to perform a specified function. It should be understood that the algorithms described herein may be stored on one or more non-transitory computer readable medium. Exemplary non-transitory computer readable mediums may include random access memory, read only memory, flash memory, and/or the like. Such non-transitory computer readable mediums may be electrically based, optically based, and/or the like.

Referring to the drawings and in particular to FIG. 1, shown therein and designated by the general reference numeral 10 is a structure constructed in accordance with the present invention. The structure 10 supports a road 12 along a road axis 14 over an underpass space 16 spanned by the structure 10. The road 12 has a predetermined width (not shown) extending in a direction 18 (FIG. 2) transverse to the road axis 14.

The road 12 may be supported on a roadbed 20 in a well-known manner. A fabric lining material 22 may extend between the road 12 and the roadbed 20 in a well-known manner. One or more temperature sensors 24 may be positioned in and/or near the road 12 for outputting signals indicative of the temperature of the road 12 so that the temperature of the road 12 can be determined. Only one sensor 24 is depicted in FIG. 1 for purposes of clarity. However, it should be understood that more than one sensor 24 may be selectively disposed in and/or near the road 12 if desired to give indications of the temperature of various different portions of the road 12.

The road 12, the roadbed 20, and the fabric lining material 22 can be any road, roadbed and fabric lining material 22 used in the construction of roads. The making and using of the road 12, roadbed 20 and fabric lining material 22 are well known in the art and a discussion of same is not deemed to be necessary herein to teach one of ordinary skill in the art how to make and use the present invention.

The structure 10 includes two footing assemblies 30 which are designated in FIG. 1 by the general reference number 30*a* and 30*b* for purposes of clarity. The footing assemblies 30 underlie the road 12 with each footing assembly 30 being securely mounted to the earth. The footing assemblies 30 extend in the direction 18, which is transverse to the road axis 14. The footing assemblies 30 are spaced apart in a direction substantially parallel to the road axis 14.

Each footing assembly 30 includes a footing 34 and plurality of steel piers 32 which are driven into the earth in a well-known manner and support the footing 34. The footing 34 can be constructed of steel reinforced concrete, for example, or any other material which is securely connectable to the earth for providing a solid foundation upon which to support the remainder of the structure 10.

The structure 10 includes a support assembly 40 supported by the footing assemblies 30. The support assembly 40 extends at least the width of the road 12 and traverses the underpass space 16 for supporting the road 12 across the underpass space 16 spanned by the structure 10. As will be discussed below, the support assembly 40 is constructed to reduce the expansion and contraction of the structure 10 due to changes in temperature and weather, while also reducing the occurrence of icing of the road 12 extending across the structure 10.

The support assembly 40 includes a substantially continuous inner shell 42 having a width at least corresponding to the width of the road 12. The inner shell 42 extends between the two footing assemblies 30 so as to define the underpass space 16 spanned by the structure 10. The inner shell 42 can be constructed of any suitable rigid, resilient material such as a plywood material covered with concrete, or a steel sheeting material covered with an epoxy coating, for example.

The support assembly 40 also includes a plurality of rigid, resilient beams 44, an insulating material 46, (FIG. 2) an outer shell 48, and a pair of sidewalls 50.

The beams 44 surmount the inner shell 42. Each beam 44 has a first end 54 supported by the footing assembly 30*a* and a second end 56 supported by the footing assembly 30*b*. The beams 44 are spatially disposed in the direction 18 which is transverse to the road axis 14 and have a longitudinal axis extending in a direction substantially parallel to the road axis 14. Each of the beams 44 can be prefabricated, arcuately shaped, rolled steel 1-beams obtainable from any suitable source of steel and can have any size so long as the beams 44 cooperate to adequately support the structure 10. The beams 44 can be spaced apart any suitable distance there between, such as four-foot centers, so that the beams 44 can adequately help to support the remainder of the structure 10 and the vehicles moving across the structure 10. In one preferred embodiment, the beams 44 are S4"×7.7 lbs. curved beams.

The insulating material 46 is positioned between each of the beams 44 for thermally isolating the road 12 from the underpass space 16 and substantially preventing the transfer of heat therethrough. In one embodiment, the insulating material 46 can be a substantially rigid insulating material such as Dowboard. The insulating material 46 can also be a blown-in insulating material, as discussed hereinafter.

The outer shell 48 has a first end 58 supported by the footing assembly 30*a*, and a second end 60, supported by the footing assembly 30*b*. The outer shell 48 substantially encases the beams 44 and the insulating material 46. The outer shell 48 can be constructed of a durable material, such as four to twelve inches of steel reinforced concrete. The thickness of the outer shell 48 can vary widely and will depend on the ultimate size of the structure 10, and the weight supported by the support assembly 40. Moreover, in one preferred embodiment where the outer shell 48 is formed on a twenty-foot inner radius, the outer shell 48 has a thickness of about twelve inches adjacent to the footing assemblies 30 and tapers downwardly to a thickness of about six inches at a height of about four feet above the footing assemblies 30. In the last example, the remainder of the outer shell 48 (beyond about four feet above the footing assemblies 30) has a constant thickness of about six inches.

Figure 2:
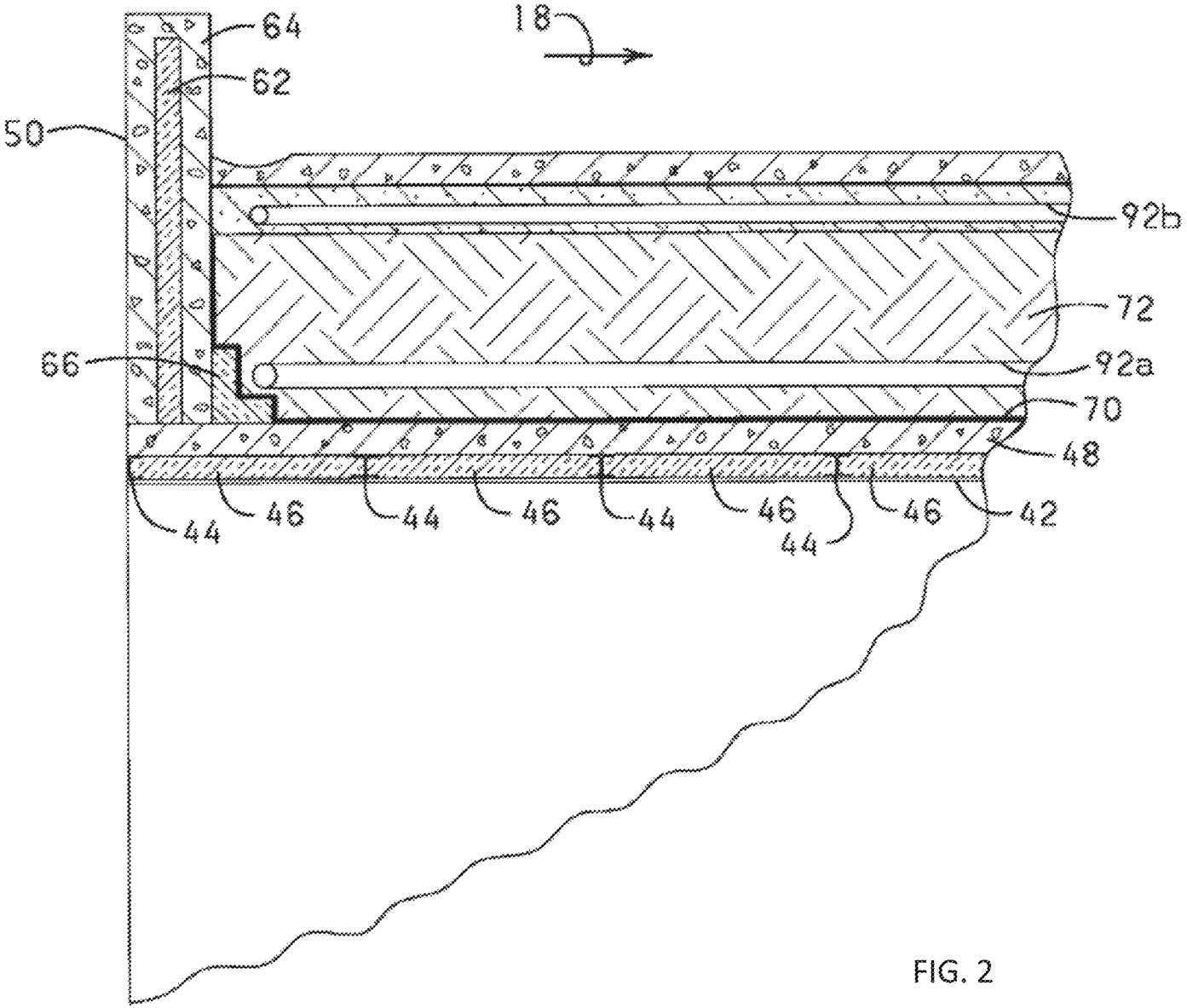
FIG. 2 is a fragmental, cross sectional view of the structure depicted in FIG. 1, taken along the lines 2-2.

Referring now to FIG. 2, shown therein is a cross-sectional, fragmental view of one half of the structure 10, taken along the lines 2-2 in FIG. 1. The structure 10 is generally symmetrical in construction, thus, it is not deemed necessary to show the other side of the structure 10.

One of the sidewalls 50 is shown in FIG. 2. The sidewalls 50 are identical in construction and function and therefore, only one will be described herein for purposes of clarity. The sidewall 50 extends upwardly from the outer shell 48 of the support assembly 40 to a position generally above the road 12. The sidewall 50 includes an inner insulating layer 62 which is encased inside an outer resilient casing 64. The inner insulating layer 62 can be a preselected amount of an insulating material so as to retard the flow of heat through the sidewall 50. In one embodiment, the inner insulating layer 62 can be constructed from approximately two inches to approximately four inches of a rigid insulating material such as Dowboard. The outer casing 64 can be constructed of any resilient, durable material such as steel reinforced concrete.

An insulating material 66 may be provided at the junction of the sidewalls 50 and the outer shell 48. As best shown in FIG. 2, the insulating material 66 may have an L-shaped cross-section such that the insulating material 66 extends along the sidewall 50, and outer shell 48 to stop the ingress and the egress of heat through the junction of the sidewalls 50 and the outer shell 48.

A substantially fluid-impermeable material 70 may substantially encases the arcuate support assembly 40, the insulating material 66, and the interior of the sidewalls 50. A fill material 72 may extend from the substantially fluid-impermeable material 70 to support the road 12. The substantially fluid-impermeable material 70 can be a delta drain brand geo composite for foundation protection obtainable through Cosella Dorken of Beamsville, Ontario Canada. The fluid-impermeable material 70 can also be a rubber polymer waterproofing membrane such as Wall-Guard brand obtainable from Valguard corporation of Oak Creek, Wis. The fill material 72 can be any suitable material, such as dried dirt, sand, aggregate, rock, or any combination thereof. The fill material 72 serves to store heat and insulate the support assembly 40 from the elements, so that the support assembly 40 is maintained at a substantially constant temperature during fluctuations of the weather. In addition, the insulating material 46, inner insulating layer 62, and the insulating material 66 cooperate with the fill material 72 to help maintain the support assembly 40 at a substantially constant temperature which will typically be the average yearly temperature in the geographic location where the structure 10 is located.

In one embodiment, a road 74 may be provided through the underpass space 16 defined by the structure 10. The road 74 may be supported on a roadbed 76, and may be divided into two or more lanes 78 divided by a median 80. A pair of culverts 82 may be provided on respective sides of the road 74 for draining water away from the road 74.

In the colder geographic regions where there are extended periods of below-freezing weather, the structure 10 may also include a temperature control assembly 90 for selectively regulating the temperature of the fill material 72 to, preferably, about the yearly annual temperature for the geographic location where the structure 10 is located to stabilize the temperature of the structure 10, and therefore prevent the expansion and contraction of the support assembly 40 and/or road 12 due to external weather conditions. The yearly annual temperature is typically in a predetermined range of between approximately 50 to 70 degrees Fahrenheit so as to retard icing on the road 12 disposed on the structure 10.

The temperature control assembly 90 may include a heat exchange assembly 92 which is spatially disposed throughout the fill material 72, the roadbed 20, the roadbed 76, the median 80, and/or the culverts 82 so as to maintain the temperature of the fill material 72, the roadbed 20, the median 80, and/or the culverts 82 within the predetermined range. The heat exchange assembly 92 which extends through the fill material 72 will be referred to hereinafter by the general reference numeral 92*a*. The heat exchange assembly 92 which extends through the roadbed 20 will be referred to hereinafter by the general reference numeral 92*b*. The heat exchange assembly 92 which extends through or underneath the roadbed 76, the median 80, and/or the culverts 82 will be referred to hereinafter by the general reference numeral 92*c*. The heat exchange assemblies 92*a*, 92*b*, and 92*c* may be referred to herein collectively as the heat exchange assembly 92.

The temperature control assembly 90 includes a temperature control source 94. The temperature control source 94 communicates with the heat exchange assemblies 92*a*, 92*b*, and 92*c* so as to selectively distribute or remove heat throughout the heat exchange assemblies 92*a*, 92*b* and 92*c* whereby heat is conductively introduced into or removed from the fill material 72, the roadbed 20, the roadbed 76, the median 80, and/or the culverts 82.

The temperature control source 94 and the heat exchange assembly 92 can be any suitable temperature control source and heat exchange assembly for emitting energy into or removing energy from the fill material 72, the roadbed 20, the roadbed 76, the median 80, and/or the culverts 82 and thereby controlling the temperature of the same. For example, the heat exchange assembly 92 can be a unitary conduit which is spatially disposed throughout the fill material 72, the roadbed 20, the roadbed 76, the median 80, and/or the culverts 82 in a serpentine pattern, or a plurality of conduits spatially disposed throughout the fill material 72, the roadbed 20, the roadbed 76, the median 80, and/or the culverts 82. In this embodiment, the temperature control source 94 would be adapted to recycle a heated or cooled fluid through the conduits of the heat exchange assembly 92 to thereby heat or cool the fill material 72, the roadbed 20, the roadbed 76, the median 80, and/or the culverts 82. The temperature control source 94 may be a water source heat pump.

Figure 3:
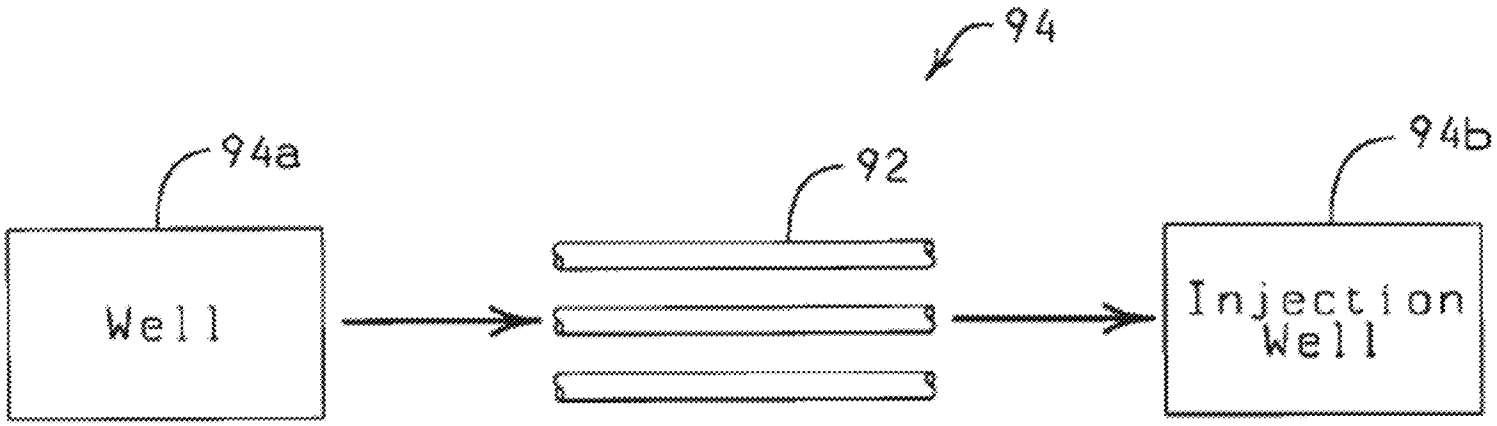
FIG. 3 is a diagrammatic, schematic view of an exemplary temperature control source supplying heat to a heat exchange assembly disposed throughout the fill material, in accordance with the present invention.

Referring now to FIG. 3, in one embodiment, the temperature control source 94 includes a well 94*a*, and an injection well 94*b*. The well 94 pumps fluid, such as water, out of the earth and through the conduits of the heat exchange assemblies 92*a*, 92*b* and 92*c*. After the fluid has passed through the heat exchange assemblies 92*a*, 92*b* and 92*c*, the fluid is moved into the injection well 94*b* where the fluid is inserted into the earth. The temperature control source 94 may also be adapted to heat the fluid coming out of the earth, or may include a heated tank of fluid for circulating through the conduits of the heat exchange assembly 92. In addition, the temperature control source 94 may also be adapted to circulate the fluid through the earth for heating or cooling the fluid.

The heat exchange assembly 92 can also be a plurality of electrical elements which are operably connected to the temperature control source 94, which in this case would be an electrical power source. The temperature control source 94 may be supplied with power from a solar energy source, or a windmill, or any other suitable source of electricity.

The temperature control source 94 communicates with the heat exchange assembly 92*a* via a fill material control valve 96 and a heat exchange line 98. The temperature control source 94 communicates with the heat exchange assembly 92*b* via a roadbed control valve 100 and a heat exchange line 102. The temperature control source 94 communicates with the heat exchange assembly 92*c* via an underpass road control valve 104 and a heat exchange line 106.

Figure 4:
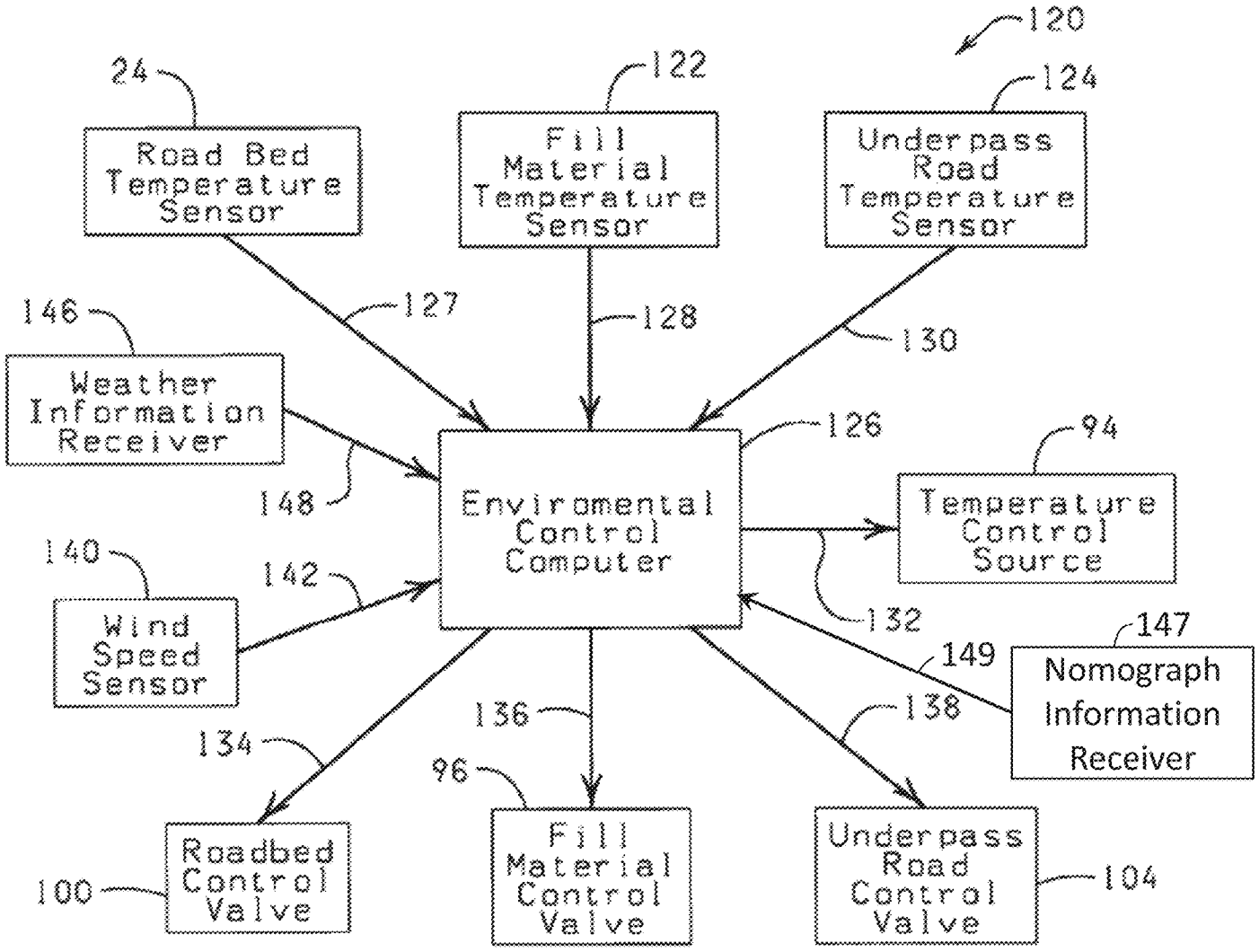
FIG. 4 is a diagrammatic, schematic view of an environmental control computer constructed in accordance with the present invention.

Referring now to FIG. 4, shown therein is a computerized control system 120 which functions to control the temperature control source 94 and the fill material control valve 96, the roadbed control valve 100, and the underpass road control valve 104 in a manner so as to maintain the temperature of various portions of the structure 10 at a predetermined temperature, such as the annual average temperature of the geographic location where the structure 10 is located.

The control system 120 includes the roadbed temperature sensor 24, one or more fill material temperature sensors 122, and one or more underpass road temperature sensors 124. The roadbed temperature sensors 24, the fill material temperature sensors 122, and the underpass road temperature sensors 124 can be spatially disposed throughout the respective road 12, fill material 72, and the road 74, the roadbed 76, the median 80, and the culverts 82. The roadbed temperature sensors 24, the fill material temperature sensors 122, and the underpass road temperature sensors 124 generate signals indicative of the temperature of the respective road 12, fill material 72 and the road 74, the roadbed 76, the median 80, and/or the culverts 82.

The control system 120 includes an environmental control computer 126. The environmental control computer 126 may comprise one or more computer processor, which may be located in one location or which may be distributed in more than one location. The environmental control computer 126 may receive the signals indicative of the temperature from the roadbed temperature sensor 24, the fill material temperature sensor 122, and/or the underpass road temperature sensor 124 via respective signal paths 127, 128 and 130. Stored in the environmental control computer 126 are pre-programmed temperature settings for maintaining each of the respective road 12, fill material 72, road 74, roadbed 76, median 80, and/or culverts 82 at the pre-programmed temperature. Based on the signals received from the sensors 24, 122 and 124, the environmental control computer 126 may output signals to the temperature control source 94 via a signal path 132, and signals to the roadbed control valve 100, fill material control valve 96, and underpass road control valve 104 via respective signal paths 134, 136, and 138 to selectively control the temperature of the roadbed 20, fill material 72, roadbed 76, median 80, and/or culverts 82 and to maintain such temperatures at the pre-programmed temperatures.

The computerized control system 120 may also be provided with a wind sensor 140 located near the structure 10. The wind sensor 140 output signals indicative of the wind speed via a signal path 142 to be received by the environmental control computer 126. The environmental control computer 126 receives these signals output by the wind sensor 140 and, in response thereto, adjusts the signals sent to the temperature control source 94, and/or the roadbed control valve 100, fill material control valve 96, and/or underpass road control valve 104 to take into account the wind chill factor when determining whether to supply heat to the roadbed 20, fill material 72, roadbed 76, median 80 and/or culverts 82. Based on decreasing temperature readings or an increasing or large wind chill factor, the environmental control computer 126 in one preferred embodiment outputs signals to the temperature control source 94 and the valves 100 and 104 to heat the roads 12 and 74, for example.

The computerized control system 120 also includes a weather information receiver 146 which is adapted to receive information regarding local weather forecasts from any suitable source, such as the national weather service. After the weather information receiver 146 receives the information regarding the weather forecast, the weather information receiver 146 transmits such information to the environmental control computer 126 via a signal path 148. Upon receiving the information from the weather information receiver 146, the environmental control computer 126 may output signals to the temperature control source 94, the roadbed control valve 100, the fill material control valve 96, and/or the underpass road control about 104 so that the structure 10 is prepared for any adverse weather conditions. For example, if the signal received from the weather information receiver 146 indicates that the structure 10 will soon be subjected to an ice storm, the environmental control computer 126 may output signals to the temperature control source 94 and the roadbed control valve 100 to begin pre-heating the roadbed 20, and thus the road 12, to prevent the road 12 from icing over.

The computerized control system 120 may also include a nomograph information receiver 147 which may be configured to receive information regarding water runoff factors, such as flow, relative imperviousness of the soil, slope of the soil, area of the surrounding land, elevation and/or terrain information of the surrounding land, intensity of precipitation, and so on. After the nomograph information receiver 147 receives information regarding ultimate future water flow, the nomograph information receiver 147 may transmit such information to the environmental control computer 126 via a signal path 149. Upon receiving the information from the nomograph information receiver 147, the environmental control computer 126 may make predictions as to the effect on the structure 10 and/or output signals to one or more components of the structure 10 to mitigate the effects of the future water flow.

It should be noted that the signal paths 127, 128, 130, 132, 134, 136, 138, 142, 148 and 149 can either be airway or cable communication links. The environmental control computer 126 may be disposed a significant distance away from the remainder of the control system 120 so as to operate remotely from the remainder of the control system 120 and thereby remotely control the operation of the structure 10.

The structure 10 may be built as follows; initially, the building site to contain the structure 10 is excavated. Then, the piers 32 of the footing assemblies 30 are driven into the earth via a hydraulic assembly, for example. Once the piers 32 are in place, the footing 34 is constructed by using steel reinforced concrete poured into forms, for example.

Once the footing assemblies 30 are constructed, the beams 44 are positioned onto the footing assemblies 30 and then anchored to the footings 34, thereof, via any suitable means, such as bolts, for example.

Thereafter, the material forming the inner shell 42 is attached to the beams 44 via any suitable method, such as bolts and the inner shell 42 is coated via any suitable material, such as spray concrete or spray epoxy, to protect the inner shell 42. Once the inner shell 42 is secured in place on the beams 44, the insulating material 46 is added between the beams 44. The insulating material 46 can be rigid pieces of insulating material, such as two-inch-thick styrofoam, Dowboard or the like, or a blown in or sprayed on insulating material to at least partially fill the cavities between the beams 44. In one preferred embodiment, the insulating material 46 only fills about ¼ to ½ of the space between the beams 44 and the other ¾ to ½ of the space between the beams 44 is later filled with concrete. Depending on the particular geographic location where the structure 10 is located, the thickness of the beams 44 and insulating material 46 can be varied so as to effectively insulate the remainder of the support assembly 40 to substantially prevent the support assembly 40 from expanding and contracting based on weather conditions. Once the insulating material 46 has cured, durable reinforcing members (not shown), such as one grid-like layer, or more than one spaced grid-like layers of a durable material, such as two spatially disposed steel grids with each grid being formed of #4 steel bars and the #4 steel bars being positioned on 12 inch centers, are positioned over the beams 44 for constructing the outer shell 48.

Once the reinforcing members, such as steel, for forming the outer shell 48 are positioned over the beams 44, a resilient, durable material, such as concrete, is disposed about the reinforcing members so as to form the outer shell 48. Depending on the size of the structure 10, the outer shell 48 should be between four to six inches. Thus, it can be seen that the insulating material 46, and the beams 44 define a form to permit the resilient, durable material to be disposed about the reinforcing members.

Thereafter, the inner insulating layers 62 of the sidewalls 50 are positioned near the ends of the outer shell 48, substantially shown in FIG. 2. A waterproofing membrane, such as Wal-Guard, discussed above, is then sprayed over the inner insulating layers 62 to protect the inner insulating layers 62 from the intrusion of water. Thereafter, rigid, reinforcing members, such as #4 steel bars positioned in a grid-like pattern on twelve-inch centers, are disposed around the inner insulating layer 62, and a resilient, durable material, such as concrete is positioned about the reinforcing members to form the sidewall 50. Once the resilient, and durable material has cured, the insulating material 66 is positioned adjacent to the interior of the sidewall 50, and on the outer shell 48.

Then, the fluid-impermeable material 70 is positioned about the outer shell 48 and the insulating material 66, and thereafter, the fill material is backfilled and compacted symmetrically on both sides over the fluid-impermeable material 70 utilizing a technique known in the art as "soil arching". Various compaction methods can be utilized when disposing the fill material 72 about the support assembly 40. The thickness of the fill material 72 can be varied based on the particular geographic location where the structure 10 is to be installed. For example, if the structure 10 is to be installed in a cooler location, such as North Dakota, the thickness of the fill material 72 can be increased so that the fill material 72 will store more energy to help reduce or prevent the occurrence of the road 12 supported by the fill material 72 from icing over. Likewise, in warmer climates (such as Georgia), it may be desirable to reduce the thickness of the fill material 72 to reduce the cost of the structure 10. In one preferred embodiment, after compaction the fill material 72 has a thickness extending over the apex of the support assembly 40 of at least about 1 foot.

If it is desired to utilize the temperature control assembly 90, the heat exchange assembly 92*a* can be positioned on a portion of the fill material 72, and then more fill material 72 can be added so that the heat exchange assembly 92 is spatially disposed throughout the fill material 72. When the fill material 72 is being added above the heat exchange assembly 92, and the heat exchange assembly 92 are conduits, the conduits can be pressurized so that the conduits will not collapse during compaction. The fill material temperature sensor 122 is positioned in the fill material 72 while the fill material 72 is being added.

Finally, when addition of the fill material 72 is complete, the road 12, roadbed 20 and fabric lining material 22 are added. If the heat exchange assembly 92*b* is desired, a portion of the roadbed 20 is poured, and the heat exchange assembly 92*b* is positioned on top of the poured portion of the roadbed 20. Once the heat exchange assembly 92*b* is positioned on top of the poured portion of the roadbed 20, the remainder of the roadbed 20 is added and the heat exchange assembly 92*b* is simultaneously pressurized to prevent same from collapsing. The fabric lining material 22 and the road 12 are then positioned on top of the roadbed 20. The roadbed temperature sensor 24 can be positioned in the road 12 while the road 12 is being constructed.

The heat exchange assembly 92*c* if desired, is then positioned underneath the structure 10. If the heat exchange assembly 92*c* includes conduits, the conduits are pressurized and the roadbed 76, road 74, median 80 and culverts 82 are positioned on top of the heat exchange assembly 92*c*. The underpass road temperature sensors 124 can be added to the roadbed 76, road 74, median 80, and/or culverts 82 as desired, during the construction of the roadbed 76, road 74, median 80, and/or culverts 82.

It will be appreciated that many changes and/or modifications can be made to the structure 10 to change or enhance the functionality of the structure 10. For example, more valves and temperature sensors can be added to the control system 120 so that the temperature of various locations on the road 12, support assembly 40, or road 74 could be monitored and compensated for via the temperature control source 94 and the environmental control computer 126. In addition, heated culverts can be added to the road 12 for safely draining away any ice or water collecting on the road 12 of the structure 10.

Furthermore, it will be appreciated that the structure 10 includes a thin shell structure which provides an isolated and insulated thermal mass for the structure 10 to maintain a year-round constant temperature for the support assembly 40 and to help prevent icing of the road 12. Moreover, the reduction in the expansion and contraction of the structure 10 increases the lifespan of the structure 10 and reduces the amount of material which must be utilized in constructing the structure 10. Finally, the dangers of the structure 10 icing in cold weather is substantially reduced.

Figure 5:
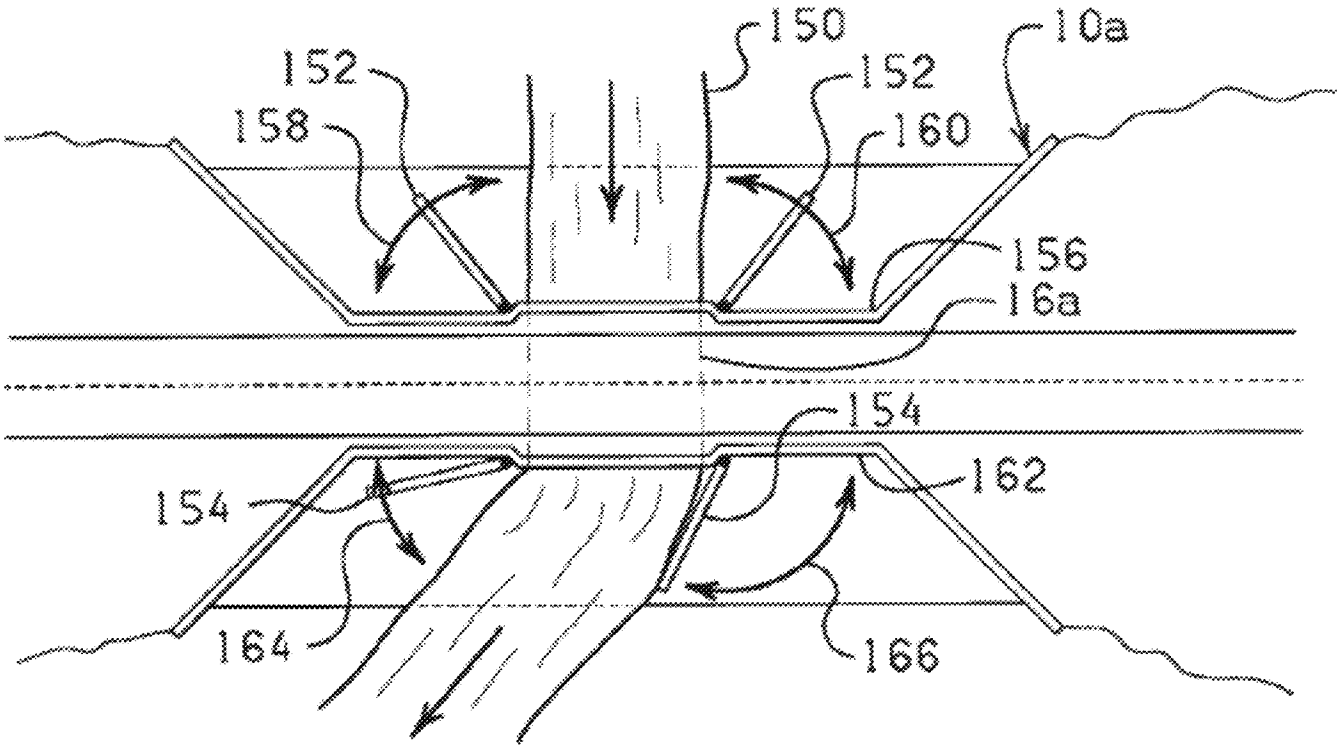
FIG. 5 is a top plan view of a second embodiment of a structure constructed in accordance with the present invention.

Referring now to FIG. 5, shown therein and designated by the reference numeral 10*a* is a second embodiment of a structure 10*a*, constructed in accordance with the present invention. The structure 10*a* is constructed in an identical manner as the structure 10, discussed herein with reference to FIGS. 1-4, except as discussed hereafter. The structure 10*a* is positioned adjacent to a river 150 such that the river 150 flows through an underpass space 16*a*. It should be understood that the term "river", as used herein, can refer to any waterway capable of passing through the underpass space 16*a*, such as a river, stream, diversion canal, or creek.

The structure 10*a* includes a pair of inlet barriers 152, and a pair of outlet barriers 154. The inlet barriers 152 are pivotally connected to an inlet side 156 of the structure 10*a*, generally on either side of the river 150. The inlet barriers 152 are selectively pivotable, as indicated by the arrows 158 and 160 so as to control or direct the movement of the water in the river 150 into the underpass space 16*a*.

The outlet barriers 154 are pivotally connected to an outlet side 162 of the structure 10*a*, generally on either side of the river 150. The outlet barriers 154 are selectively pivotable as indicated by the arrows 164 and 166 so as to direct or control the direction of flow of the water in the river 150 as it exits from the underpass space 16*a*.

The inlet barriers 152, and outlet barriers 154 can be constructed of any suitable material, such as steel, or steel reinforced concrete. In addition, the inlet barriers 152, and the outlet barriers 154 can be pivotally connected to the respective inlet side 156, and the outlet side 162, of the structure 10*a* by any suitable mechanical assembly, such as hinges. The movement of the inlet barriers 152 and outlet barriers 154, as indicated by the arrows 158, 160, 164 and 166 can be accomplished by any suitable assembly, such as a mechanical assembly. For example, hydraulic cylinders (not shown) can be utilized to selectively move the inlet barriers 152 and the outlet barriers 154. The assemblies utilized for moving the inlet barriers 152 and the outlet barriers 154 can be remotely or locally controlled by the environmental control computer 126.

Figure 6:
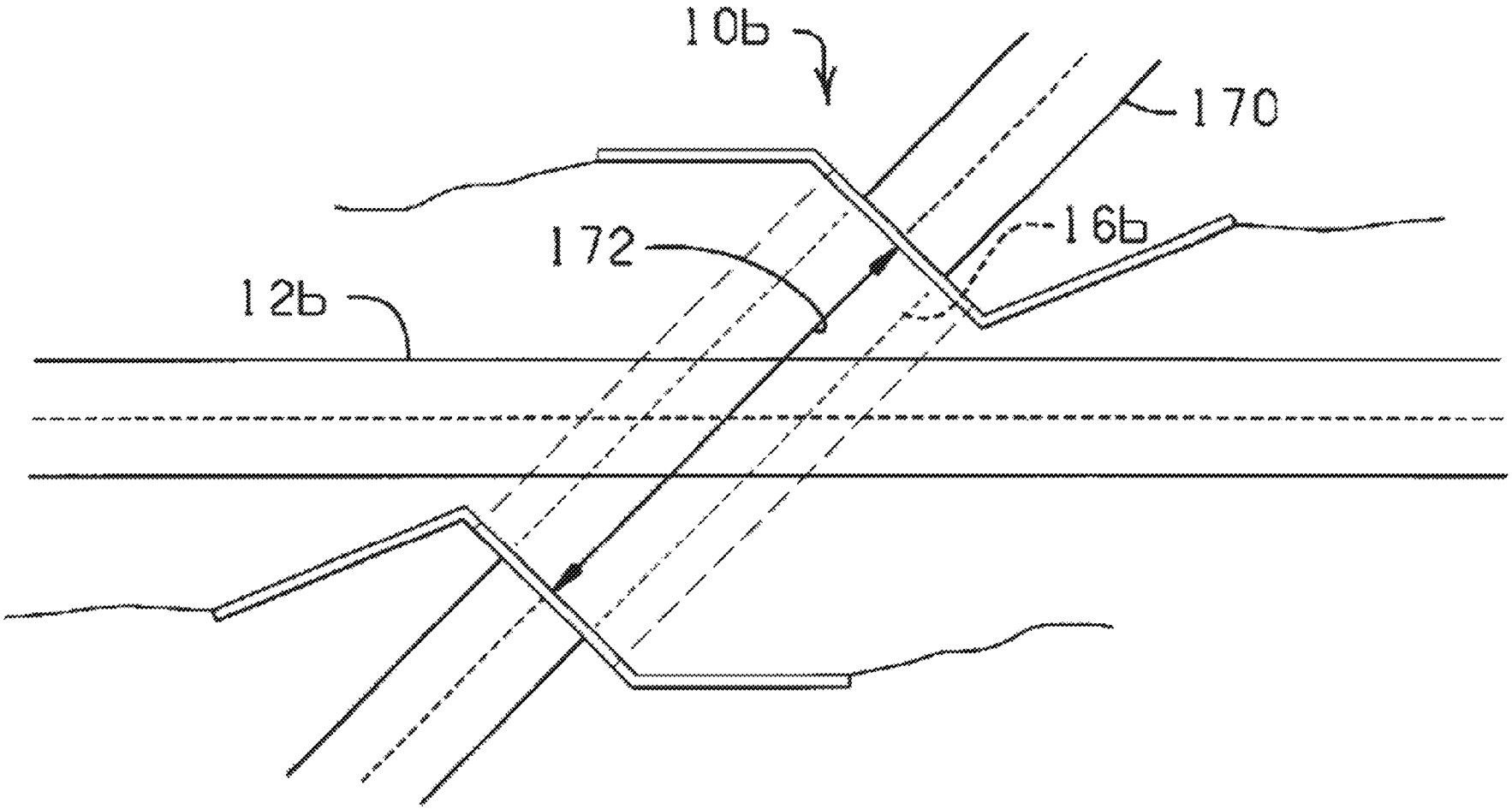
FIG. 6 is a top plan view of a third embodiment of a structure constructed in accordance with the present invention.

Referring now to FIG. 6, shown therein and designated by the reference numeral 10*b* is another embodiment of a structure 10*b*, which is constructed in accordance with the present invention. The structure 10*b* is constructed in an identical manner as the structures 10 and 10*a* (which were described hereinbefore with reference to FIGS. 1-5) except as discussed hereinafter.

The structure 10*b* supports a road 12*b* over an underpass space 16*b*. A road 170 passes through the underpass space 16*b*. The structure 10*b* have a width 172. The angle between the road 12*b*, supported by the structure 10*b*, and the road 170 passing through the underpass space 16*b* can be varied upon constructing the structure 10*b*, simply by adjusting the width 172 and the orientation of the structure 10*b* so that there is an adequate area supported by the structure 10*b* to fully support the road 12*b*.

Figure 7:
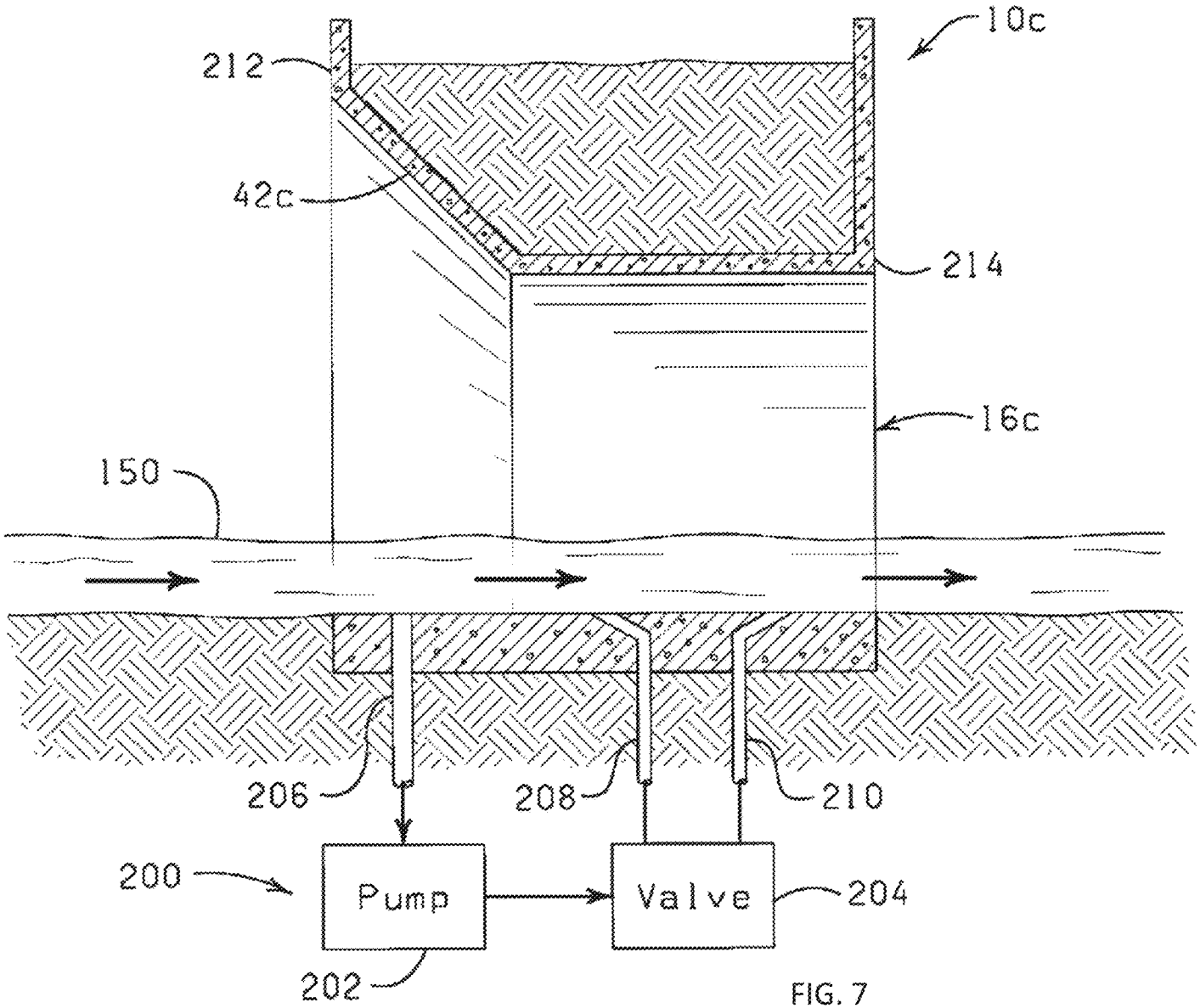
FIG. 7 is a sectional view of a fourth embodiment of a structure constructed in accordance with the present invention.

Referring now to FIG. 7, shown therein and designated by the general reference numeral 10*c*, is another embodiment of a structure 10*c*, which is constructed in accordance with the present invention. The structure 10*c* is constructed in a similar manner as the structure 10*a*, except as discussed below. The structure 10*c* includes a flow control assembly 200 for controlling the rate of flow of the river 150 passing through an underpass space 16*c* thereof. The flow control assembly 200 includes a pump 202, and a valve 204. The pump 202 receives water from the river 150 through an inlet 206 communicating with the underpass space 16*c*. When actuated, the pump 202 draws water from the river 150 through the inlet 206, and ejects pressurized water through the valve 204 to control the rate of flow of the river 150. The environmental control computer 126 can be utilized to selectively actuate the pump 202.

The valve 204 can be selectively actuated by the environmental control computer 126 to direct the water provided by the pump 202 to either enhance or reduce the flow of the river 150 through the underpass space 16*c*. That is, the valve 204 communicates with a first outlet 208, and a second outlet 210. The first outlet 208 is positioned to direct the pressurized water passing through the valve 204 in a direction generally against the flow of the river 150. The second outlet 210 is positioned to direct the water passing through the valve 204 in a direction generally with the flow of the river 150.

When the valve 204 is actuated such that the water received by the valve 204 is directed to the first outlet 208, force is applied to the river 150 to decrease the flow of the river 150 through the underpass space 16*c*. When the valve 204 is actuated such that the water received by the valve 204 is directed to the second outlet 210, force is applied to the river 150 to increase the flow of the river 150 through the underpass space 16*c*.

Although the flow control assembly 200 has been described herein as the pump 202 in combination with the valve 204, the inlet 206, the first outlet 208 and the second outlet 210, it should be understood that the flow control assembly 200 could be any suitable assembly for accomplishing the purpose of controlling the rate of flow of the river 150. For example, the flow control assembly 200 could include a rotatable propeller (not shown) positioned in the underpass space 16*c*. The propeller could be powered by any suitable drive train, such as a motor or engine and associated transmission.

It should be noted that the flow control assembly 200 can be utilized in combination with the movable inlet barriers 152, and the outlet barriers 154 so that the direction and speed of the flow of the river 150 can be simultaneously controlled.

It should also be noted that an inner shell 42*c* of the structure 10*c* can be tapered from an inlet side 212 of the structure 10*c* towards an outlet side 214 of the structure 10*c* to reduce the cross-section of the underpass space 16*c* and thereby slow the rate of flow of the river 150 through the underpass space 16*c*.

Figure 8:
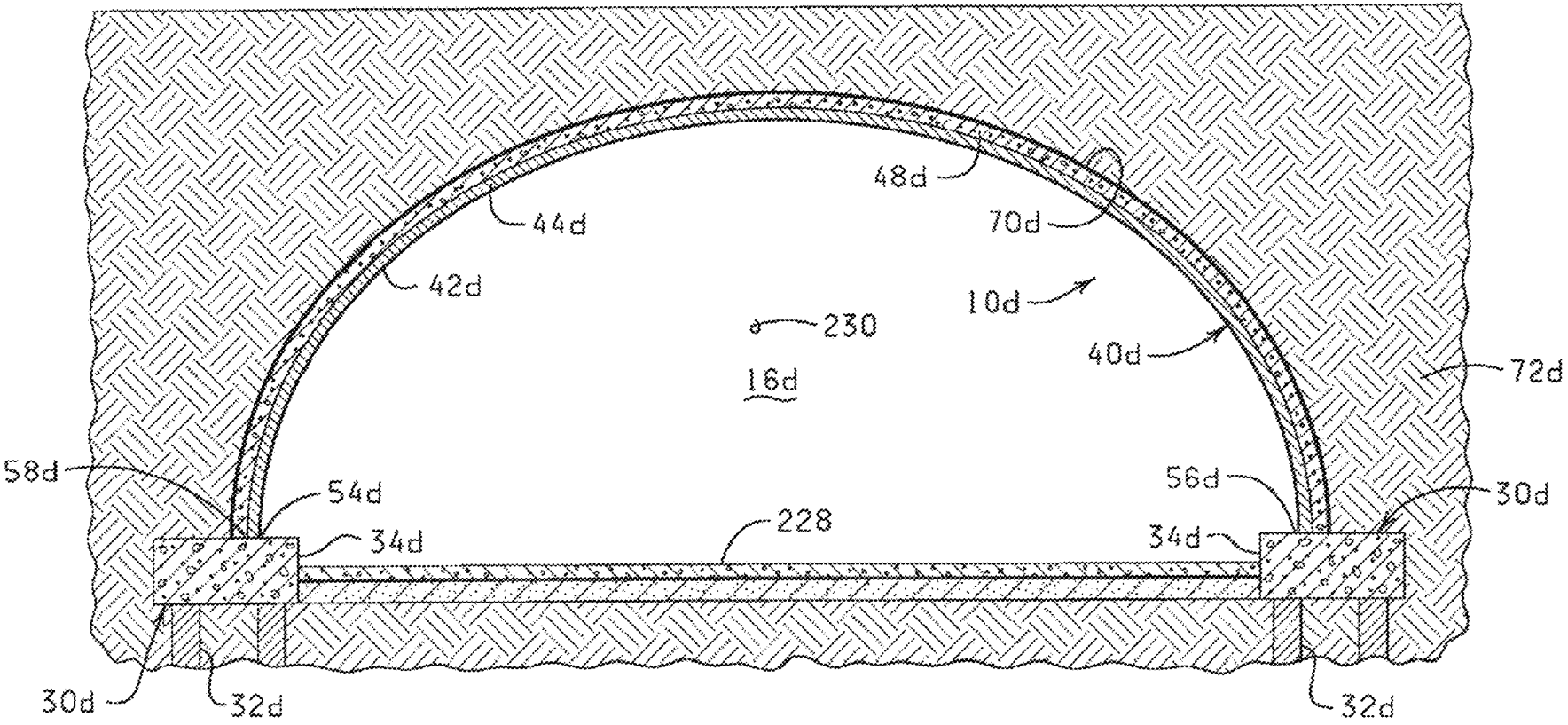
FIG. 8 is a sectional view of a fifth embodiment of a structure constructed in accordance with the present invention.

Referring now to FIG. 8, shown therein and designated by the general reference numeral 10*d* is a fifth embodiment of a structure 10*d* constructed in accordance with the present invention. The structure 10*d* is constructed in a similar manner as the structure 10, except as that the roads 74, median 80, and culverts 82 have been removed and replaced with a continuous bottom 228, extending in between the footings 30*d*. The continuous bottom 228 can be formed of steel reinforced concrete, or in one preferred embodiment is constructed in an identical manner as the support assembly 40. For purposes of clarity, elements in common between the structures 10 and 10*d* will not be described hereinafter, but are labeled in FIG. 8 with the same numeral prefix followed by the alphabetic suffix "d".

In general, the structure 10*d* forms a culvert or a pipeline positioned below a fill material 72*d*, such as the earth. The structure 10*d* defines a bore 229, which can be utilized for transporting fluids, such as water or waste. The structure 10*d* forming the culvert has a longitudinal axis 230 (shown as extending into the page) of any predetermined length. For example, the longitudinal axis 230 can have a length of 100 feet, one mile, four miles or 100 miles. The entire structure 10*d* extends along the longitudinal axis 230. For example, if the longitudinal axis 230 of the structure 10*d* has a length of one mile, then each of the footings 30*d* have a length of one mile, the bore 229 has a length of one mile, and the continuous bottom 228 has a length of one mile, for example.

The structure 10*d* is constructed in a similar manner as the structure 10, which was described hereinbefore with reference to FIGS. 1 and 2, except as described below. In the structure 10*d*, the continuous bottom 228 may be formed in between the footings 30*d* rather than the roads 74, median 80, and culverts 82.

In one preferred embodiment, the continuous bottom 228 has an arcuate cross-sectional shape so that the bore 229 is provided with a cylindrical shape. A liner (not shown), such as stainless steel, plastic or glass can be sprayed on or otherwise secured to the interior of the structure 10*d* to accommodate a variety of different fluids to be transported. In this last embodiment, the liner would surround and define the bore 229. The particular type of liner would be selected based on the type of fluid that the structure 10*d* would be utilized to transport.

Figure 9:
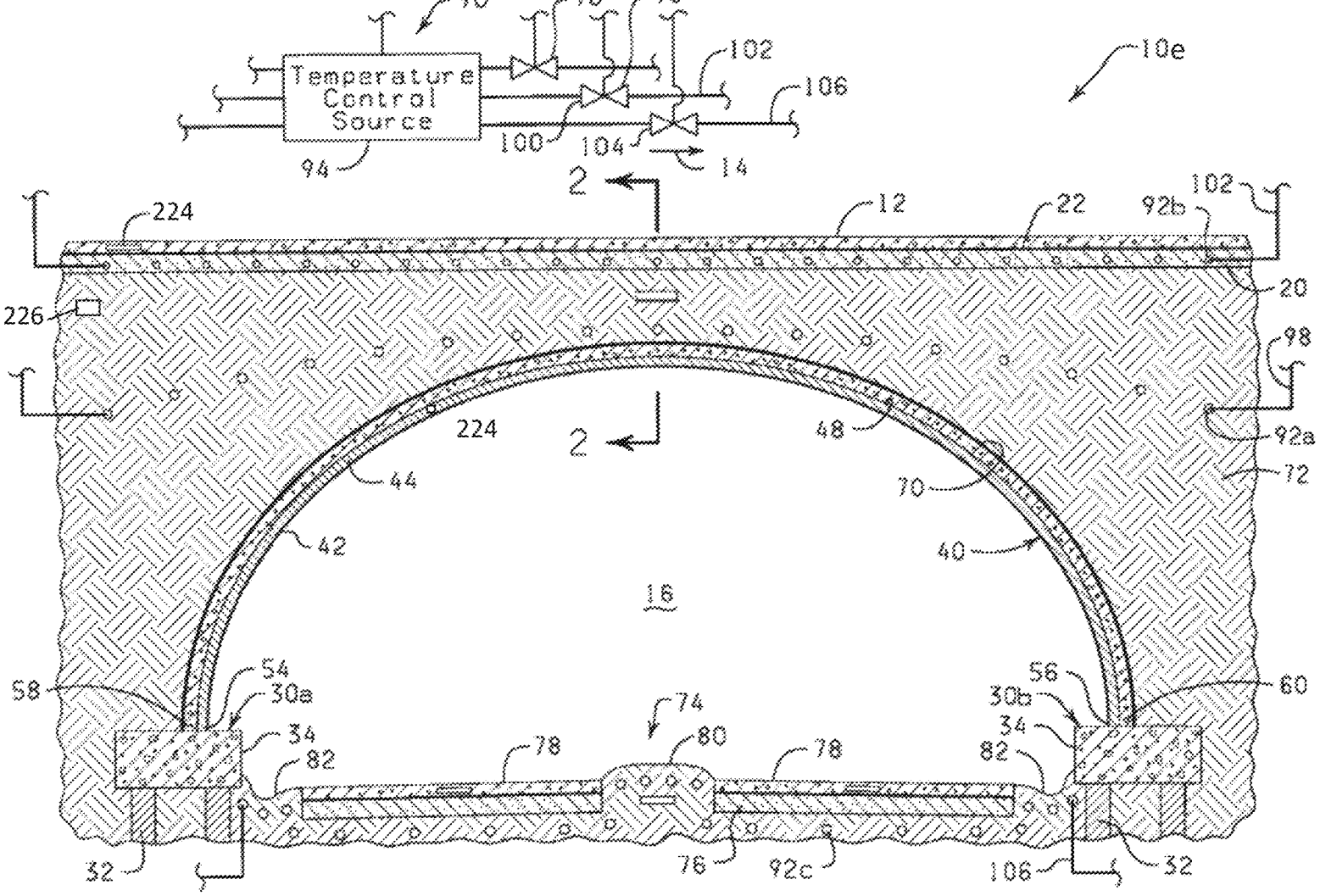
FIG. 9 is sectional view of another exemplary structure constructed in accordance with the present invention.

Referring now to FIG. 9, shown therein and designated by the reference numeral 10*e* is another embodiment of a structure 10*e*, constructed in accordance with the present invention. The structure 10*e* is constructed in the same manner as the structure 10, discussed herein with reference to FIGS. 1-4, except as discussed hereafter.

In one embodiment, the outer shell 48 of the structure 10*e* may be constructed of flexible concrete also known as engineered cementitious concrete. Flexible concrete has a higher strain capacity than ordinary concrete. For example, flexible concrete may have a strain capacity in the range of approximately 3% to approximately 7%, compared to 0.01% for ordinary portland cement, paste, mortar or concrete. Flexible concrete is more ductile than other concrete. This ductility helps flexible concrete withstand higher levels of shaking, expansion, and forces that would result in the structural failure of ordinary concrete. As one non-exclusive example, the ductile properties of flexible concrete may increase the resistance to damage of the structure 10*e* from applied forces, such as those experienced in earthquakes.

In one embodiment, the outer shell 48 may be formed of reinforced flexible concrete. The reinforced flexible concrete has more strength than concrete that is not reinforced. Flexible concrete and reinforced flexible concrete may be known as "specialty concrete."

In one embodiment, the temperature control source 94 includes a reverse cycle chiller or air chiller that does not require a cooling tower. In one embodiment, the temperature control source 94 may comprise a compressed-air based vortex cooler such as those based on a vortex tube, water source heat pump, or other suitable heating, cooling, or heating/cooling unit which is environmentally friendly (that is, which is energy efficient). The temperature control source 94 may comprise a compressed-air based vortex cooler which can be obtained from ITW VORTEC of Cincinnati, Ohio.

The composition of compressed-air based vortex coolers is well known to those having ordinary skill in the art and so will not be explained in detail herein. However, in general, compressed-air based vortex coolers utilize pressurized gas (or air) that is injected into a chamber and accelerated to a high rate of rotation to form a vortex. The outer, hotter, portion of gases of the vortex is allowed to escape while the inner, colder, portion of the gases of the vortex is forced in an inner vortex of reduced diameter and can be output at cooler temperatures than the original gas injection. The cooler gases can be used to exchange heat with other materials.

In one embodiment, the temperature control source 94 and/or any other elements of the structure 10 may be powered with renewable energy sources. Non-exclusive examples of renewable energy sources include wind-based, solar-based, and hydro-electric energy sources.

In one embodiment, one or more temperature sensors 24 may comprise one or more wireless temperature sensor. The wireless temperature sensors 24 may be configured to transmit sensor data wirelessly as input data to the environmental control computer 126 (see FIG. 4) and/or to additional monitoring devices (such as other computer processors including laptops, desktop computers, handheld computer devices, and/or smart phones/watches, and so on). The wireless sensors 24 may be configured to receive information wirelessly from the environmental control computer 126 and/or the additional monitoring devices.

The environmental control computer 126 may be configured to receive (in any manner, including wirelessly or via wires) input data from the one or more temperature sensors 24 indicative of the condition of the atmosphere surrounding the structure 10*e*, the condition of the structure 10*e*, and/or the condition of the road 12. For example, the environmental control computer 126 may be configured to receive (in any manner, including wirelessly or via wires) input data from the one or more temperature sensors 24 indicative of the temperature of the structure 10*e* and/or the road 12. Further, the environmental control computer 126 may be configured to receive (in any manner, including wirelessly or via wires) input regarding environmental conditions (including past, current, and/or forecasted conditions) around and/or heading toward the structure 10*e* and/or road 12. In one embodiment, the input regarding environmental conditions (including past, current, and/or forecasted conditions) may be referred to as "climate injection" input 255.

The environmental control computer 126 may control operation of the temperature control source 94 based on the received input from the one or more sensor 24 and/or the received climate injection input 255 regarding the environmental conditions. In one embodiment, the environmental control computer 126 may control operation of one or more of the other components of the structure 10*e* based on the received input from the one or more temperature sensor 24 and/or the received climate injection input 255 regarding the environmental conditions.

In one embodiment, the environmental control computer 126 may be configured to control operation of the one or more other components of the structure 10*e* (such as the temperature control source 94) based on the received input from the one or more temperature sensor 24 and/or the received input regarding the environmental conditions and/or based on predicting the effect of environmental conditions on the structure 10*e* and/or the road 12.

In one embodiment, predicting the effect of environmental conditions on the structure 10*e* and/or the road 12 may be based on the use of one or more of artificial intelligence, machine learning, and neural networks. In one embodiment, predicting the effect of environmental conditions on the structure 10*e* and/or the road 12 may be based on the use of algorithms that mimic the human brain's behavior.

In one embodiment, predicting the effect of environmental conditions outside the structure 10*e* on the structure 10*e* and/or the road 12 may be based on the use of algorithms that factor in continuously changing physical variables (such as temperature, for example) and the effect of other physical variables using automatic feedback control (the use of feedback information to correct and/or "train" the algorithms to continuously improve the output of the algorithms).

The environmental control computer 126 may be configured to execute computer readable instructions, which may include algorithms, that generate and/or use an engineering system model to predict the behavior (that is, the response) of the structure 10*e* and/or the road 12 based on predicted environmental conditions in the future. In some implementations, generating the model may be based, at least in part, on an iterative process of predictions and actual measurements used to improve the model and future predictions.

The environmental control computer 126 may be configured to execute computer readable instructions to carry out one or more procedures. The environmental control computer 126 may be configured to execute computer readable instructions that control one or more of the other components of the structure 10*e* in order to maintain a neutral, substantially unchanging, state of the structure 10*e* and/or of the road 12. In some implementations, the neutral, substantially unchanging, state of the structure 10*e* and/or of the road 12 comprises maintaining the road 12 and/or the structure 10*e* within a predetermined temperature range.

For example, the environmental control computer 126 may control operation of the temperature control source 94 and one or more of the heat exchange assemblies 92*a*, 92*b*, 92*c* in order to maintain a neutral, substantially unchanging, temperature of the structure 10*e* and/or of the road 12, including during changing external environmental conditions.

In one embodiment, the environmental control computer 126 may receive meteorological information and predictions for the external environment from external sources. Nonexclusive examples of external sources include the National Oceanic and Atmospheric Administration, from the National Weather Service, from the National Weather Center in Norman, Okla., from geographically local public meteorological sources, and/or from private meteorological information sources. In one embodiment, the environmental control computer 126 may create meteorological information and predictions utilizing one or more computer processor executing computer readable instructions and/or information from one or more external sensors positioned in the external environment. The one or more computer processor may execute such computer readable instructions utilizing one or more of, or combinations of, machine learning techniques, artificial intelligence techniques, neural network techniques, system modeling techniques, and/or predictive algorithms.

For example, the environmental control computer 126 may control operation of the temperature control source 94 and one or more of the heat exchange assemblies 92*a*, 92*b*, 92*c* in order to maintain a neutral, substantially unchanging, temperature of the structure 10*e* and/or of the road 12 (which may include maintaining the temperature within a predetermined temperature range), by incrementally changing the temperature of the structure 10*e* and/or the road 12 to compensate for predicted changes in the environment and/or predicted effects of changes in the environment on the structure 10*e* and/or the road 12.

In one embodiment, information from the temperature sensors 24, the meteorological information, and/or the meteorological predictions may be used to determine predictive maintenance of the structure 10*e* and/or or the road 12. For example, if severe heat or severe storms with high winds are predicted, the structure 10*e* and/or road 12 may require inspection or repair as a result of the heat or storms.

In one embodiment, predicting the effect of environmental conditions outside the structure 10*e* on the structure 10*e* and/or the road 12 may be further based on information regarding the heat transfer properties of one or more materials used in the structure 10*e* and/or the road 12. For example, heat transfer properties may include the rate of heat transfer through a particular material used in the construction of the structure 10*e* and the road 12. Heat transfer properties may be expressed as thermal conductivity or thermal resistivity or heat conduction. Heat transfer properties may further take into account one or more of the mass of the material, the surface area of the material, and/or other characteristics of the material.

In some implementations, the environmental control computer 126 and/or one or more computer processors may be configured to execute software that causes the environmental control computer 126 and/or one or more computer processors to receive temperature data from the one or more temperature sensors 24 indicative of one or more of temperature of the road 12 and temperature of the support assembly 40; receive weather forecast data; predict changes to the temperature of the support assembly 40 and the road 12 based on the temperature data and the weather forecast data; and send one or more signals to the temperature control assembly 90 indicative of commands to control application or removal of heat to the support assembly 40, based on the predicted changes to the temperature of the support assembly 40 and the road 12, such that the support assembly 40 maintains a temperature within a first predetermined range resulting in the road 12 maintaining a temperature within a second predetermined range, the second predetermined range being a range above the freezing point of water.

In one embodiment, the structure 10*e* may comprise one or more condition sensor 224. In some implementations, the one or more condition sensors 224 may comprise one or more of the following: a stress sensor, a strain sensor, and a load sensor. The one or more condition sensors 224 may be wired or wireless. Information from the one or more condition sensors 224 may be utilized to determine if maintenance is needed to repair or replace the structure 10*e* and/or the road 12, and/or may be used during construction of the structure 10 and/or the road 12.

In one embodiment, the structure 10*e* may comprise one or more seismic sensor 226. The environmental control computer 126 may receive information regarding seismic activity from the one or more seismic sensor 226 and/or may receive information regarding seismic activity from seismic warning systems. One example of a seismic warning system is QuakeGuard, manufactured by Seismic Warning Systems, Inc., of Scotts Valley, Calif. Another example of a seismic warning system is the California Earthquake Early Warning System, which uses ground motion sensors from across California to detect earthquakes, and is a joint project of the Office of Emergency Service, the U.S. Geological Service, UC Berkeley, CalTech, and others. The environmental control computer 126 may execute computer readable instructions to control the structure 10*e* and/or the road 12 based on the received information regarding seismic activity from the seismic warning systems and/or based on seismic prediction data. In one example, the environmental control computer 126 may execute computer readable instructions to send a signal to a roadway system to activate warning signs near the road 12 indicative of seismic activity based on the seismic data and/or to activate barriers to move into place to stop access to the road 12 based on the seismic data.

Figure 10A:
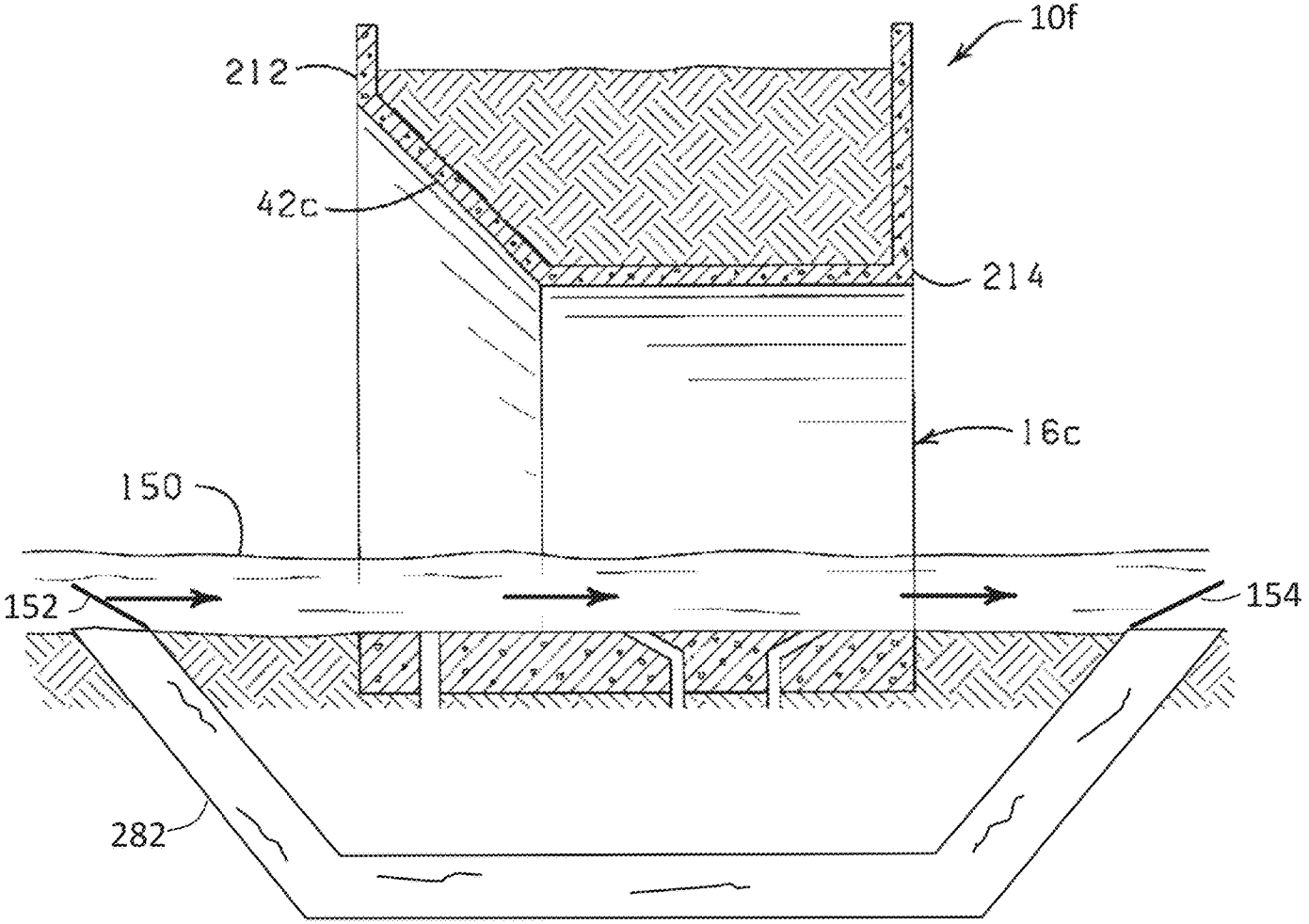
FIG. 10A is sectional view of yet another structure constructed in accordance with the present invention.

Referring now to FIG. 10A, shown therein and designated by the reference numeral 10*f* is another embodiment of a structure 10*f*, constructed in accordance with the present invention. The structure 10*f* may be constructed in the same manner as the structure 10, discussed herein with reference to FIGS. 1-4, or in the same manner as the structure 10*a*, discussed herein with reference to FIG. 5, except as discussed hereafter. The structure 10*f* may comprise one or more second culvert 282. The second culverts 282 may be positioned to move water from the underpass space 16, 16*c* (and/or before or after entering the underpass space 16, 16*c*) to a second location. For example, the one or more second culvert 282 may be positioned to move water to an upstream location or a downstream location. One or more inlet barrier 152 and/or outlet barrier 154 may be used in conjunction with the second culverts 282 to control the flow of water through the second culverts 282. In one embodiment, the one or more second culvert 282 may be positioned underneath the structure 10*f* and/or may be positioned adjacent to the structure 10*f*.

In some implementations, the first culvert 82 may have a first end and a second end and a length between the first end and the second end. The length of the first culvert 82 may be positioned through the underpass space 16*c*. The first culvert 82 may be configured to transfer water through the underpass space 16*c*. The second culvert 282 may have a first end positioned on a first side of the support assembly 40 and connected to the first end of the first culvert 82, a second end positioned on a second side of the support assembly 40, and a length between the first end and the second end and positioned around the support assembly 40. The second culvert 282 may be configured to transfer water around the support assembly 40.

In one embodiment, the environmental control computer 126 and/or one or more computer processors may receive water information from one or more meteorological sensor 324, the nomograph information receiver 147, and/or from external information sources regarding meteorological conditions, meteorological predictions, precipitation levels, snow melt levels/speeds, water flow frequency/intensity, etc., that may affect the structure 10*f* and/or the area surrounding the structure 10*f*. The environmental control computer 126 may utilize the water information to control and/or monitor the culverts 82, 282 and the more inlet barrier 152 and/or outlet barrier 154 based on actual conditions and/or predicted conditions that may impact the structure 10*f* and/or the area surrounding the structure 10*f*. The one or more meteorological sensor 324 may comprise, one or more barometer, moisture sensor, rain gage, snow gage, anemometer, soil moisture, soil temperature, ground water level sensor, radar, and so on.

In one embodiment, the environmental control computer 126 and/or one or more computer processors may generate a model to predict the water volume input to the underpass space 16*c* based on water volume data and precipitation forecast data. In some implementations, generating the model may be an iterative process based on repeating predictions of the water volume and actual measurements of the water volume to verify the predictions, and thereby improve the model. Predicting water volume input to the underpass space 16*c* may be based on use of one or more of artificial intelligence, machine learning, and neural networks.

In one embodiment, the diameter of one or more of the first culvert 82 and/or second culvert 282 may be determined based on pipe flow diagrams or nomographs, so as to provide the necessary capacity for water flow volume and velocity. The determinations may include calculating a runoff and/or runoff coefficient indicative of water flow toward the structure 10, 10*f* from the surrounding land area. The runoff coefficient may be estimated from a consideration of the "relative imperviousness" and the "slope" of the surface (soil) of the surrounding land from which water would flow towards the structure 10, 10*f*. The size of the land area may be measured from maps of the area, or provided from another source. Intensity of precipitation may be based on "time-intensity curve of precipitation" for a storm of a certain frequency of occurrence and/or from a "rainfall formula" derived for such a storm.

In use, the second culverts 282 may be used as an alternative or additional water passage through, around, above, and/or under the underpass space 16*c*. One example is the use of the second culverts 282 to handle water overflow, such as in a flood. Another example is to split water flow between the culvert 82 and/or the underpass space 16*c* and the second culvert(s) 282. Another example is to divert water flow entirely through the second culvert(s) 282. The one or more second culvert 282 may be used to direct water away from the structure 10*f*. The second culverts 282 may be used to direct water to another use, for example, for irrigation, for reservoir use, or other application.

The culverts 82, 282 may create a water path to channel water around or through an obstructing man-made feature, such as the structure 10-10*f*, thereby restoring a natural water path and/or diverging and utilizing excess storm water flow.

In some implementations, the environmental control computer 126 and/or one or more computer processors may be configured to execute computer software that causes the environmental control computer 126 and/or one or more computer processors to receive precipitation forecast data; receive water volume data for water flowing toward the underpass space; predict water volume input to the underpass space 16*c* based on the water volume data and the precipitation forecast data; and control the position of one or more of the movable inlet barriers 152 and/or the outlet barriers 154 to control flow of water within the first culvert 82 and the second culvert 282 based on the predicted water volume input.

FIG. 10A illustrates a work-around partially full, low head, empirically designed convert concept.

Figure 10B:
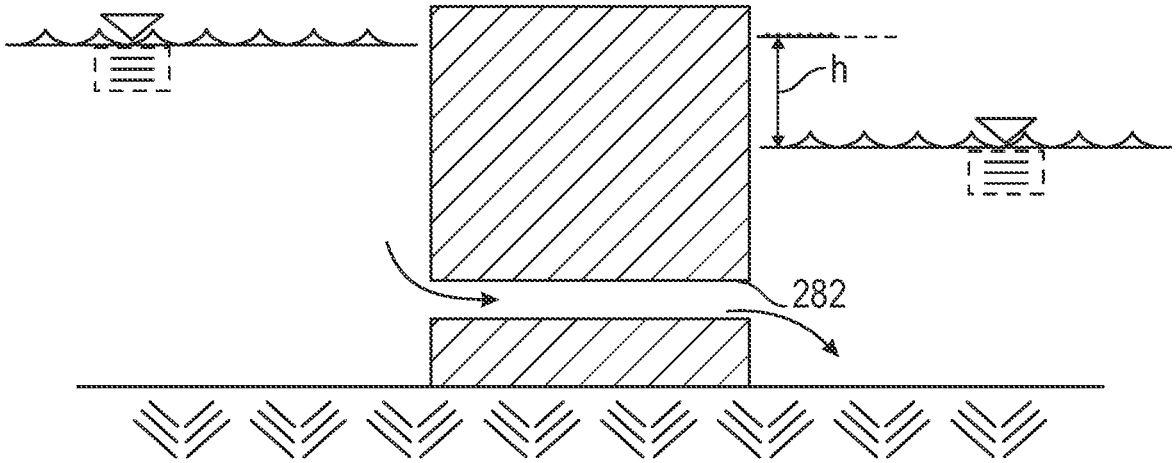
FIG. 10B is sectional view of yet another structure constructed in accordance with the present invention.

FIG. 10B illustrates a through-channel culvert concept with both the entrance and exit submerged, where a version of Torricelli equation applies.

Figure 10C:
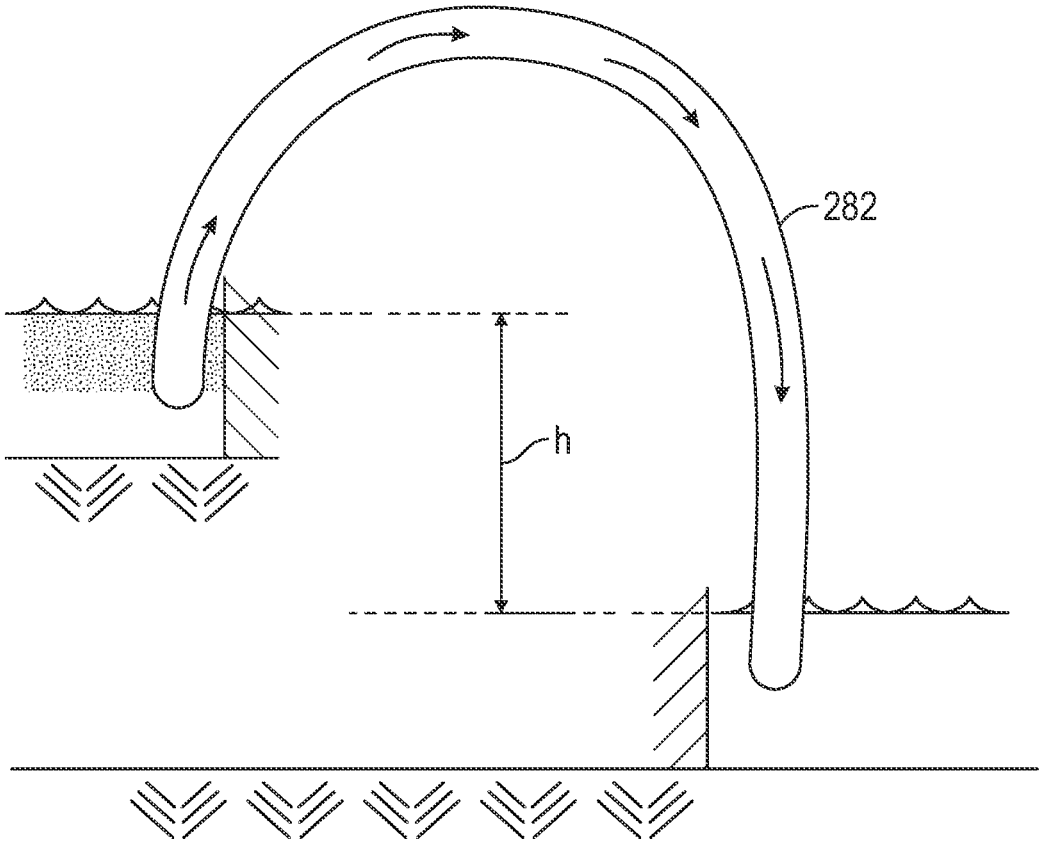
FIG. 10C is sectional view of yet another structure constructed in accordance with the present invention.

FIG. 10C illustrates an embodiment for use in certain highly special circumstance, in which siphon concepts can be utilized.

The design and control of the culverts 82, 282 lends itself to the rational method of storm drain design which may employ, for example, the following equation:

$$Q=c*i*A$$

where "Q" is runoff in feet per second; "c" is a runoff coefficient or expected ratio of runoff to rainfall; "i" is intensity of precipitation over time (for example, in feet per acre per second or inches per acre per hour); and "A" is the drain area (for example, area of a number of acres).

The above can be utilized in a computer model and enhanced by artificial intelligence (for example, variation in frequency and magnitude of storms in each geographic/topographic area) for each bridge design where drainage is of concern.

Figure 11:
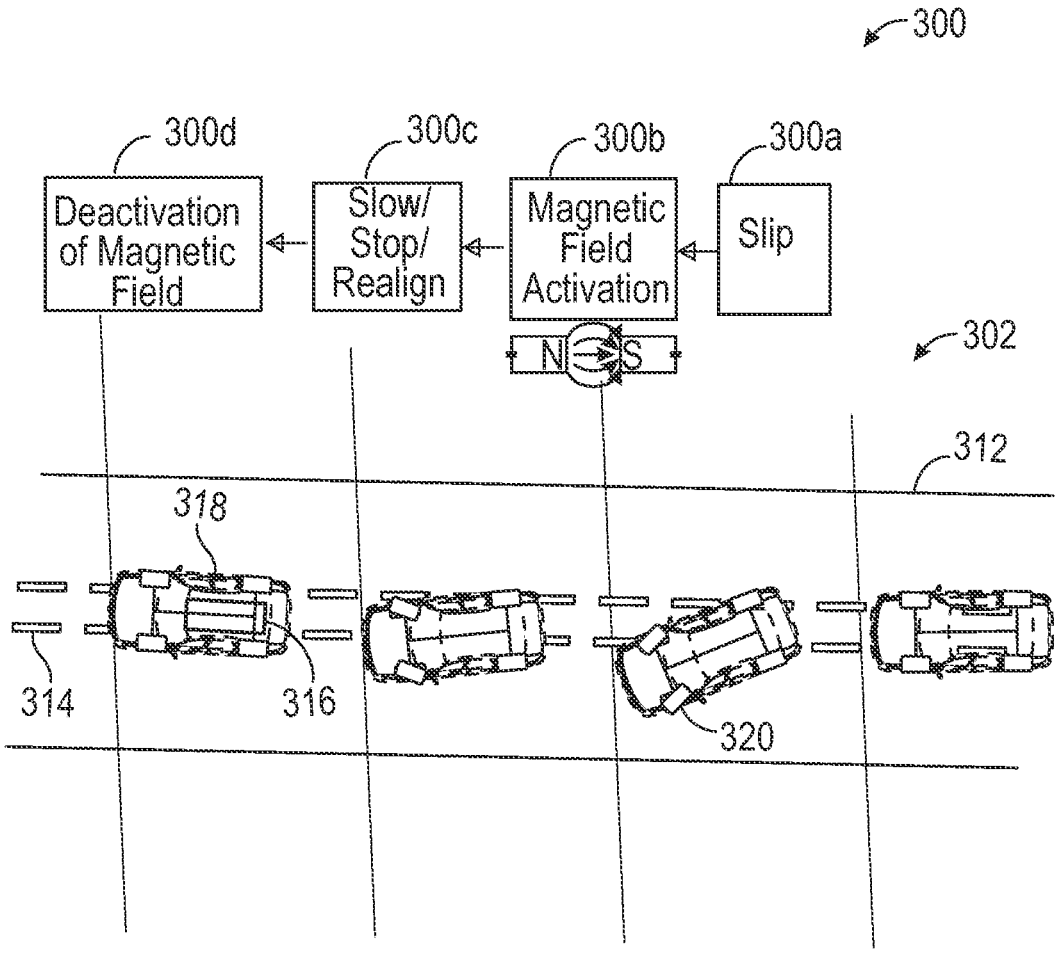
FIG. 11 is a top plan view of an exemplary roadway system in accordance with the present disclosure.
Figure 11:
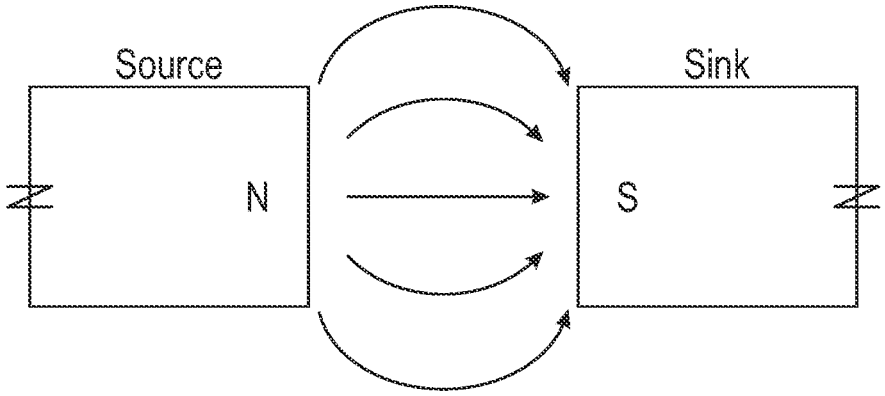

Referring now to FIG. 11, shown therein and designated by the reference numeral 300 is an embodiment of a road system 302, constructed in accordance with the present invention. The road system 302 comprises a road 312. In some implementations, the road system 302 comprises the road 312 and an electrical charging device 316, such as a solenoid. The road 312 may be similar to road 12, except as discussed hereafter. The road 312 contains a ferrous material 314. The ferrous material 314 may be magnetized when the solenoid 316 producing an electric charge travels over the ferrous material 314 in the road 312. For example, the solenoid 316 may be positioned in or on a vehicle 318 traveling on the road 312. The ferrous material 314 may be positioned in the road 312 in a pattern that may, when magnetized, apply a pattern of magnetic force to the vehicle 318, such that the vehicle 318 is pulled in a predetermined direction, such as toward the center of a lane in the road 312, so as to align the vehicle 318 with the road 312, as shown in FIG. 11. Additionally, or alternative, the ferrous material 314 may be positioned in the road 312 such that the ferrous material may be magnetized to slow or stop the vehicle. As shown in FIG. 11, if a vehicle 318 slips (in a first step 300*a*) from alignment with the road 312, the magnetic field may be activated and/or strengthened (in a second step 300*b*), which acts to slow, stop, and/or realign the vehicle 318 (in a third step 300*c*). Then, in some implementations, the magnetic field may be deactivated (in a fourth step 300*d*). In some implementations magnetic flux density may be equal to permeability of free space multiplied by magnetic field strength multiplied by susceptibility plus one.

In one embodiment, the vehicle 318 may produce the source (north pole) while the road 312 may act as the sink (south pole) for a magnetic system. Lines of magnetic flux are directed from the north pole (i.e., the magnetic source) to the south pole (i.e., the magnetic sink).

The road 312 may contain magnetically "soft" material, non-exclusive examples of which include silicon-iron, permalloy, and soft ferrite, which are materials that do not remain aligned when the external field is removed (that is, do not stay "magnetized"). These materials can be re-magnetized in any polarity from a subsequent exposure to a magnetic field. The hysteresis loss and effectivity product are low for the magnetically soft material used in solenoids, transformers, and motors, for example. With an alternating current, the magnetic field may be reversed, such as, for example, with a frequency of 60 Hz (50 Hz in Europe and other areas). The road 312 may contain other additional or alternative material that may be magnetized.

In one embodiment, the current may be an alternating current and the ferrous material may be de-magnetized by reversing the polarity.

In one embodiment, increasing the intensity of an electrical field (that is, increasing the current) may increase the strength of the magnetic field.

In some implementations, the road system 302 may utilize the electrical charging device 316 and ferrous material 314 as "electromagnetic brakes" to slow or stop and or align motion using electromagnetic force directly (that is, not relying on mechanical resistance such as friction or eddy (circular) current). The vehicle 318 may have tires 320 filled with gas(es), both of which may act as insulation. Accurate tension control may be achieved by utilizing the electromagnetic brakes.

Magnetic particles (which may be very similar to iron filings) may be located strategically in the road 312. When an electric current is applied to a coil, a resulting magnetic flux tries to bind the particles together, like a magnetic particle slush. As the electric current is increased, the binding of the particles become stronger. A brake rotor of the vehicle 318 passes through the field of these bound particles. As the particles start to bind together, a resistant force is created on the rotor, slowing and eventually stopping the shaft. In some implementations, alignment of the vehicle 318 on the road 312 may be achieved also or instead.

The road system 302 may have a wide operating torque range. The relationship of torque to voltage is almost linear. The torque can be controlled very accurately, that is, within the operating RPM range of the unit. The road system 302 may be used effectively for tension control and provides a fast response. The road system 302 may include an automatic fail safe in that, when the current is stopped or alternated, the tension on the vehicle 318 is released.

Changes may be made in the embodiments depicted and described herein, or in the elements, steps and/or sequence of steps of the methods described herein without departing from the spirit and the scope of the invention as defined in the following claims.

Even though particular combinations of features are recited in the claims and/or disclosed in the specification, these combinations are not intended to limit the disclosure. In fact, many of these features may be combined in ways not specifically recited in the claims and/or disclosed in the specification. Although each dependent claim listed below may directly depend on only one other claim, the disclosure includes each dependent claim in combination with every other claim in the claim set.

What is claimed is:

1. A structure for supporting a road over an underpass space spanned by the structure, comprising:

two footings underlying a road and mounted to the earth, the footings being spaced apart in a direction substantially parallel to a longitudinal axis of the road, the road having a width extending in the direction transverse to the longitudinal axis;

a support assembly supported by the footings and underlying the road, the support assembly having an arcuate shape and extending at least the width of the road and traversing an underpass space spanned by the structure for supporting the road across the underpass space spanned by the structure, the support assembly comprising:

a substantially continuous inner shell having a width at least corresponding to the width of the road, and extending between the two footings so as to define the underpass space spanned by the structure;

a plurality of beams surmounting the inner shell, each beam having a first end supported by a first footing of the footings, and a second end supported by a second footing of the footings, the beams being spatially disposed in a direction transverse to the longitudinal axis of the road and having a longitudinal axis extending in a direction substantially parallel to the longitudinal axis of the road;

an insulating material being positioned between each of the beams for thermally isolating the road and the remainder of the support assembly from the underpass space and substantially reducing transfer of heat therethrough to the underpass space; and an outer shell having a first end supported by the first footing, and a second end supported by the second footing, the outer shell positioned above the beams and the insulating material;

one or more temperature control assembly configured to apply heat to and remove heat from the support assembly;

one or more temperature sensors disposed in the road and the support assembly;

one or more condition sensors disposed in the road; and one or more computer processors configured to execute software that causes the one or more computer processors to:

receive temperature data from the one or more temperature sensors indicative of one or more of temperature of the road and temperature of the support assembly;

receive weather forecast data;

predict changes to the temperature of the support assembly and the road based on the temperature data and the weather forecast data;

send one or more signals to the temperature control assembly indicative of commands to control application or removal of heat to the support assembly, based on the predicted changes to the temperature of the support assembly and the road, such that the support assembly maintains a temperature within a first predetermined range resulting in the road maintaining a temperature within a second predetermined range, the second predetermined range being a range above the freezing point of water; and determine if maintenance is needed on at least one of the support assembly and the road based on data from the condition sensors.

2. The structure of claim 1, wherein predicting changes to the temperature of the support assembly and the road is based on use of one or more of artificial intelligence, machine learning, and neural networks.

3. The structure of claim 1, wherein the one or more temperature control assembly further comprises one or more heat exchange assemblies positioned within the support assembly.

4. The structure of claim 1, wherein the one or more temperature control assembly further comprises one or more reverse cycle chiller.

5. The structure of claim 4, wherein the one or more reverse cycle chiller includes a compressed-air based vortex cooler.

6. The structure of claim 1, wherein the one or more temperature sensors include one or more wireless temperature sensor and wherein the one or more computer processors are configured to execute software that causes the one or more computer processors to receive temperature data wirelessly.

7. The structure of claim 1, wherein the one or more computer processors are configured to execute software that causes the one or more computer processors to:

generate a model to predict changes to the temperature of the support assembly and the road based on the temperature data and the weather forecast data.

8. The structure of claim 7, wherein generating the model is an iterative process based on predictions and actual measurements.

9. The structure of claim 1, wherein the outer shell is constructed of reinforced flexible concrete.

10. The structure of claim 1, the one or more computer processors configured to execute software that causes the one or more computer processors to: activate warning signs.

11. A method, comprising:

receiving temperature data from one or more temperature sensors disposed in a road and in a support assembly underlying the road, the temperature data indicative of one or more of temperature of the road and temperature of the support assembly, the road having a longitudinal axis and a width extending in a direction transverse to the longitudinal axis, the support assembly having an arcuate shape and extending at least the width of the road and traversing an underpass space, the support assembly comprising:

a substantially continuous inner shell having a width at least corresponding to the width of the road, and extending between two footings underlying the road and mounted to the earth, the footings being spaced apart in a direction substantially parallel to the longitudinal axis of the road, so as to define an underpass space;

a plurality of beams surmounting the inner shell, each beam having a first end supported by a first footing of the footings, and a second end supported by a second footing of the footings, the beams being spatially disposed in a direction transverse to the longitudinal axis of the road and having a longitudinal axis extending in a direction substantially parallel to the longitudinal axis of the road;

an insulating material being positioned between each of the beams for thermally isolating the road and the remainder of the support assembly from the underpass space and substantially reducing transfer of heat therethrough to the underpass space; and an outer shell having a first end supported by the first footing, and a second end supported by the second footing, the outer shell positioned above the beams and the insulating material;

receiving weather forecast data;

predicting changes to the temperature of the support assembly and the road based on the temperature data and the weather forecast data;

sending one or more signals to one or more temperature control assemblies indicative of commands to control application or removal of heat to the support assembly, based on the predicted changes to the temperature of the support assembly and the road, such that the support assembly maintains a temperature within a first predetermined range resulting in the road maintaining a temperature within a second predetermined range, the second predetermined range being a range above the freezing point of water;

receiving data from one or more condition sensors disposed in the road; and determining if maintenance is needed on at least one of the support assembly and the road based on data from the condition sensors.

12. The method of claim 11, wherein predicting changes to the temperature of the support assembly and the road is based on use of one or more of artificial intelligence, machine learning, and neural networks.

13. The method of claim 11, wherein the one or more temperature control assemblies comprise one or more heat exchange assemblies positioned within the support assembly.

14. The method of claim 11, wherein the one or more temperature control assemblies comprise one or more reverse cycle chiller.

15. The method of claim 14, wherein the one or more reverse cycle chiller includes a compressed-air based vortex cooler.

16. The method of claim 11, wherein the one or more temperature sensors include one or more wireless temperature sensor; and wherein receiving temperature data comprises receiving temperature data wirelessly.

17. The method of claim 11, comprising:

generating a model to predict changes to the temperature of the support assembly and the road based on the temperature data and the weather forecast data using an iterative process based on predictions and actual measurements.

18. The method of claim 11, wherein the outer shell is constructed of reinforced flexible concrete.

* * * * *